US007909160B2

(12) United States Patent
Patterson et al.

(10) Patent No.: US 7,909,160 B2
(45) Date of Patent: Mar. 22, 2011

(54) MIXING CAP AND METHOD FOR USE THEREOF

(75) Inventors: Brent Patterson, Roswell, GA (US); Randy Patterson, Houston, TX (US)

(73) Assignee: Abrigo, Ltd, Las Vegas, NV (US)

( * ) Notice: Subject to any disclaimer, the term of this patent is extended or adjusted under 35 U.S.C. 154(b) by 523 days.

(21) Appl. No.: 11/900,666

(22) Filed: Sep. 13, 2007

(65) Prior Publication Data

US 2008/0067084 A1 Mar. 20, 2008

Related U.S. Application Data

(63) Continuation-in-part of application No. 11/400,907, filed on Apr. 10, 2006, now Pat. No. 7,464,811, which is a continuation of application No. 11/115,466, filed on Apr. 27, 2005, now Pat. No. 7,055,685.

(51) Int. Cl.
*B65D 25/08* (2006.01)

(52) U.S. Cl. ..... 206/221; 222/145.1

(58) Field of Classification Search ..... 206/219–222, 206/568; 215/6, DIG. 8; 222/83, 129, 145.1, 222/216, 219, 548; 426/115, 120
See application file for complete search history.

(56) References Cited

U.S. PATENT DOCUMENTS

| | | | | |
|---|---|---|---|---|
| 3,156,369 | A | 11/1964 | Bowes et al. | |
| 4,515,267 | A | 5/1985 | Welsh | |
| 5,027,872 | A * | 7/1991 | Taylor et al. | 206/219 |
| 5,152,965 | A | 10/1992 | Fisk et al. | |
| 5,419,445 | A | 5/1995 | Kaesemeyer | |
| 5,433,328 | A | 7/1995 | Baron et al. | |
| 5,794,802 | A | 8/1998 | Caola | |
| 5,984,141 | A * | 11/1999 | Gibler | 206/219 |
| 6,152,296 | A | 11/2000 | Shih | |
| 6,221,416 | B1 | 4/2001 | Nohren, Jr. | |
| 6,372,270 | B1 | 4/2002 | Denny | |
| 6,527,110 | B2 * | 3/2003 | Moscovitz | 206/222 |
| 6,569,329 | B1 | 5/2003 | Nohren, Jr. | |
| 6,644,471 | B1 | 11/2003 | Anderson | |
| 6,705,490 | B1 * | 3/2004 | Lizerbram et al. | 206/221 |
| 6,886,686 | B2 | 5/2005 | Anderson | |
| 7,055,685 | B1 | 6/2006 | Patterson et al. | |
| 2002/0090426 | A1 | 7/2002 | Denny | |
| 2003/0072850 | A1 | 4/2003 | Burniski | |
| 2004/0200740 | A1 | 10/2004 | Cho | |
| 2004/0200742 | A1 | 10/2004 | Cho | |
| 2006/0260959 | A1 | 11/2006 | Patterson et al. | |

FOREIGN PATENT DOCUMENTS

| | | | |
|---|---|---|---|
| JP | 2003/081357 | A | 3/2003 |
| JP | 2004/083022 | A | 3/2004 |
| WO | WO/2006/115506 | | 11/2006 |

* cited by examiner

*Primary Examiner* — Luan K Bui
(74) *Attorney, Agent, or Firm* — Woodcock Washburn LLP

(57) ABSTRACT

A mixing cap and method for use thereof, wherein the mixing cap is preferably pre-loaded during time of manufacture with selected dry or liquid ingredients to facilitate subsequent consumer use. The mixing cap comprises an apertured inner tube threadably-engageable to the mouth of a bottle, and an outer housing cooperatively-engaged with the inner tube and slidably-restricted thereover via a ridge and slotted flange arrangement. Preloaded ingredients contained within the outer housing may be introduced or discharged into the bottle by simply depressing the outer housing over the inner tube when the ridge is aligned with the slot, thereby permitting the ingredients to flow through the apertures of the outer housing and inner tube and into the liquid contents of the bottle. The combined ingredients and liquid within the bottle may subsequently be shaken without fear or risk of leakage or spillage.

8 Claims, 36 Drawing Sheets

MIXING CAP AND METHOD FOR USE THEREOF

RELATED APPLICATIONS

To the fullest extent permitted by law, the present continuation-in-part patent application claims priority to, and the full benefit of, U.S. patent application Ser. No. 11/400,907, entitled "Mixing Cap and Method for Use Thereof", filed on Apr. 10, 2006, U.S. Pat. No. 7,464,811, incorporated herein by reference, which is a continuation of U.S. patent application Ser. No. 11/115,466, entitled "Mixing Cap and Method for Use Thereof", filed on Apr. 27, 2005, now U.S. Pat. No. 7,055,685, also incorporated herein by reference.

TECHNICAL FIELD

The present invention relates generally to caps for liquid-containing bottles, and more specifically to a mixing cap for engaging the mouth of a conventional water bottle, or other liquid-containing bottle, for enabling one or more dry or liquid ingredient(s) contained within the mixing cap to be conveniently and selectively dispensed into the bottle and mixed with the water or other liquid contents thereof.

BACKGROUND OF THE INVENTION

Protein powders, energy mixes, supplements, and other sports nutritional products are frequently utilized in conjunction with regular exercise to promote a healthy lifestyle. Accordingly, consumers often purchase large containers or bulk quantities of their favorite or preferred nutritional supplement powders or mixes, wherein most such powders or drink mixes must be combined with water or other suitable liquids to facilitate ingestion and digestion of same. However, despite the economical advantages and general long-term product supply afforded by such bulk purchases, the impracticalities and inconveniencies associated with the use of such large containers of powders or mixes, in view of preferred consumer use and consumption patterns, present noticeable disadvantages.

Specifically, many individuals utilize public gyms or fitness centers, wherein immediately before or following an exercise session, many such individuals prefer to ingest a favorite powdered sports drink for optimal bodily absorption. Accordingly, these individuals are often forced to inconveniently tote large containers of powder to their fitness center for subsequent use, or to "pre-bag" or "pre-package" smaller portions thereof prior to leaving home.

Additionally, because such powders must be combined with a liquid, consumers must undertake the time-consuming, and often messy, process of properly combining and mixing the powder with a glass or bottle of water. That is, when utilizing a glass or other wide-mouthed container of water, the consumer must measure and deposit the appropriate amount of sports powder within the glass and, thereafter, shake, stir or otherwise fully mix the combined dry and liquid contents. In doing so, powder and/or powder-liquid mix may spill from the wide mouth of the glass, resulting not only in mess and partial loss of product, but a potentially significant reduction in the manufacturer's recommended serving size. This latter disadvantage becomes particularly problematic when the consumer has painstakingly "pre-measured" and bagged or packed a limited amount of sports powder for use at his/her fitness center, leaving the much larger container of sports powder at his/her residence.

To avoid the spillage problems associated with mixing powdered sports drinks in wide-mouthed containers of liquid, consumers may utilize a conventional personal-sized bottle of water, which typically has a dimensionally smaller mouth compared to a conventional drinking glass. In use, the bottle cap may be threadably engaged to the bottle mouth following deposit of the sports powder therethrough, thus enabling rapid and forcefully shaking, and uniform mixture of the powder-water contents of the bottle, without risk of leakage or spillage of same. However, in utilizing such a water bottle, consumers must attempt to feed or funnel the powder through the relatively narrow mouth of the bottle, which, more often than not, results in spillage of the sports powder.

As such, in an attempt to overcome the disadvantages associated with the foregoing systems for, and methods of, sports nutritional supplement drink preparation, many available devices provide for a mixing cap engageable to a liquid container, wherein the mixing cap enables introduction of a dry or liquid ingredient into the communicating bottle for mixture with the liquid contents thereof. Examples of such devices may be seen with reference to U.S. Patent Publication No. 2004/0200742A1 to Cho; U.S. Patent Publication No. 2004/0200740A1 to Cho; U.S. Patent Publication No. 2003/0072850 A1 to Burniski; U.S. Patent Publication No. 2002/0090426 A1 to Denny; U.S. Pat. No. 6,569,329 B1 to Nohren, Jr.; U.S. Pat. No. 6,372,270 B1 to Denny; U.S. Pat. No. 6,221,416 B1 to Nohren, Jr.; U.S. Pat. No. 6,152,296 to Shih; U.S. Pat. No. 5,984,141 to Gibler; U.S. Pat. No. 5,794,802 to Caola; U.S. Pat. No. 5,433,328 to Baron et al.; and, U.S. Pat. No. 5,419,445 to Kaesemeyer. However, the foregoing references teach devices possessing structural and functional features and limitations, which, in addition to being unnecessarily complex, render use of the devices largely inconvenient.

For example U.S. Pat. No. 5,984,141 to Gibler (Gibler '141) discloses a beverage storage and mixing device comprising a cap assembly attached to a conventional drink bottle, wherein the cap assembly comprises an inner cylindrical housing rotatably nested within an outer cylindrical housing. In use, apertures formed through the inner and outer housings must be properly aligned to effectively enable liquid contained within the cap to be dispensed into the communicating bottle. The cap assembly of Gibler '141 further requires the rupturing of a bottom wall for full introduction and mixing of the liquid from the cap assembly with the liquid contents of the communicating bottle.

U.S. Pat. No. 5,443,328 to Baron et al. (Baron '328) teaches a baby bottle comprising a storage container for holding food material, wherein the storage container is adapted to fit between the tubular mouth of a baby bottle and a nipple-supporting end cap of the baby bottle. The bottle further comprises a release mechanism coupled to the mouth of the baby bottle for controlling access to the food material contained in the storage container body by water stored in the baby bottle. To operate the release mechanism, the nipple-supporting end cap is pulled upwards to dislodge a stopper from an aperture in the release mechanism, thereby enabling access to the food material by the water upon shaking the baby bottle. However, not only is the Baron '328 device structurally-limited to standard baby bottles, which traditionally have wide mouths, the device would not effectively prevent spillage or spray of the food material and water from the nipple of the end cap during the shaking process; thus, resulting in mess and, even with use of a nipple cover or cap, partial loss of product.

U.S. Patent Application Publication No. 2004/0200740 to Cho (Cho '740) discloses a cap device and bottle, whereupon rotating the cap device relative to the bottle enables mixing of an additive contained within the cap with a material contained within the communicating bottle. That is, a valve unit is threadably-engaged with an additive-containing unit, wherein the valve unit is engaged, threadably or via frictional-fit, to the mouth of a bottle. Unthreading of the additive-containing unit from the valve unit disengages a stopper carried by the valve unit from an aperture formed in the additive-containing unit, thus enabling the additive to enter the communicating bottle. However, in addition to the inconvenience associated with the Cho '740 multi-step process of having to threadably engage the valve unit with the additive-containing unit, and then the valve unit with a bottle, and, thereafter, unthread the additive-containing unit from the valve unit to enable introduction of the additive to the bottle contents, the structural design of Cho '740 is further flawed, as the user may inadvertently completely unthread and remove the additive-containing unit from the valve unit and, thus, release or spill the additive therefrom. Even if not fully unthreaded, an insufficient number of engaged threads between the additive-containing unit and the valve unit will result in a weak seal or engagement and, thus, ineffectively prevent leakage of the additive-liquid mix from the cap device during the shaking and mixing process.

Therefore, it is readily apparent that there is a need for a mixing cap and method for use thereof, wherein the mixing cap engages the mouth of a conventional personal-sized water bottle, or other liquid-containing bottle, and wherein simply depressing the mixing cap enables dry or liquid ingredients contained within the mixing cap (i.e., loaded during time of manufacture, or initial consumer use) to be expeditiously and conveniently deposited into the bottle, and whereupon shaking the bottle effectively intermixes the water or other liquid contents thereof with the added ingredient, without risk of spillage or leakage of the mixture therefrom.

BRIEF SUMMARY OF THE INVENTION

Briefly described, in a preferred embodiment, the present invention overcomes the above-mentioned disadvantages, and meets the recognized need for such a device by providing a mixing cap and method for use thereof, wherein the mixing cap is preferably pre-loaded, such as during a time of manufacture, with at least one selected dry or liquid ingredient within a separate compartment to facilitate subsequent consumer use. The mixing cap comprises an apertured inner tube threadably-engageable to the mouth of a bottle, and an outer housing operable with the inner tube and slidably-restricted thereover via a ridge and slotted flange arrangement. Pre-loaded ingredients contained within one or more separate compartment(s) of the outer housing may be introduced or discharged into the bottle by simply depressing the outer housing over the inner tube when the ridge is aligned with the slot, thereby permitting the ingredients to flow through apertures of the outer housing and the inner tube and into the liquid contents of the bottle. The combined ingredients and liquid within the bottle may subsequently be shaken without fear or risk of leakage or spillage.

According to its major aspects and broadly stated, the present invention in its preferred form is a mixing cap and method for use thereof, wherein the mixing cap generally preferably comprises a mixing cap including an outer housing and an inner tube operable therewith, the outer housing and the inner tube having guide means capable of limiting relative motion between the outer housing and inner tube to selectively permit or allow communication between a bottle and one or more compartment.

According to another aspect, the mixing cap comprises an outer housing and an inner tube cooperatively engaged with the outer housing, wherein depression of said outer housing over said inner tube allows an ingredient disposed in said outer housing to pass through a central bore in the inner tube, and wherein rotation of the outer cap about the inner tube selectively allows such depression.

Generally, the present invention is a mixing cap having an apertured inner tube, an apertured outer housing, a ridge and a slotted flange integrally formed therewith. The outer housing is preferably pre-loaded during time of manufacture with at least one selected dry or liquid ingredient in a separate compartment to facilitate subsequent consumer use; however, it is contemplated that the outer housing may be loaded with at least one selected ingredient at time of initial consumer use (i.e., post-manufacture). The present mixing cap is preferably threadably-engageable to the mouth of a conventional personal-sized water bottle, other liquid-containing bottle, or both. It should be recognized that the technology of the present invention may be appropriately modified to accommodate the various structural properties of a selected bottle or of selected bottles, including, without limitation, mouth diameter, flanged mouths, threaded or unthreaded mouths, and/or the like.

More specifically, the present invention is a mixing cap and method for use thereof, wherein the mixing cap preferably comprises a pre-loaded outer housing operable with an inner tube, wherein the inner tube is preferably engageable with a mouth of at least one type of bottle. The outer housing preferably comprises at least one separate storage compartment in communication with an opening therein. The outer housing may be shaped as a torus, including a central opening through which the inner tube extends. The inner tube preferably comprises a top wall in communication with a hollow, cylindrical-shaped sidewall, wherein the sidewall preferably comprises at least one aperture formed therethrough. Axial movement of the outer housing with respect to the inner tube may be restricted via a ridge disposed axially along one of the inner tube and the outer housing, and may be engageable with a slotted flange carried by the other. Additionally, a second flange arrangement disposed proximate the central opening of the mixing cap preferably further provides an effective sealing means during use of the present invention.

When the mixing cap is in a "closed position", the pre-loaded ingredients or contents are maintained within separate storage compartment of the outer housing by virtue of the hollow, cylindrical-shaped sidewall of the inner tube functioning as an effective seal between the storage compartment and the hollow center of the inner tube, and, thus, the bottle. Additionally, in such a closed position, the apertures of the inner tube are disposed against and covered by the inner wall of the outer housing.

As such, to place the mixing cap into an "open position", so that the contents of the outer housing may be introduced or discharged into the communicating bottle, the slot in the flange may be aligned with the ridge, whereafter the outer housing may be sufficiently depressed to downwardly slide the outer housing over the inner tube, whereby an alignment of the openings of at least one separate compartment and the inner tube results. In such a configuration, the contents of the separate compartment(s) may flow through the sidewall apertures of the outer housing and the inner tube and into the bottle. Preferably, a bottom surface of the outer housing facilitates such flow, and prevents settling or accumulation of the contents thereon. The combined ingredients and liquid within the bottle may subsequently be shaken without fear or risk of leakage or spillage. Following the shaking process, removal of the mixing cap enables consumption of the fully mixed beverage. Alternatively, the slotted flange and ridge arrangement may be reversed, or may be replaced by alternative structures, such as a tab and channel arrangement, or the like, whereby relative movement of the outer housing with respect to the inner tube may be controlled or restricted, such that selective opening or one or more compartment(s) of the outer housing may be accomplished.

Accordingly, a feature and advantage of the present invention is its ability to facilitate the introduction of a dry or liquid ingredient into a bottle, without risk of spillage of the ingredient.

Another feature and advantage of the present invention is its ability to facilitate the mixing of a dry or liquid ingredient with the contents of a bottle, without risk of spillage of the ingredient or bottle contents.

Still another feature and advantage of the present invention is its ability to provide a pre-loaded mixing cap.

Yet another feature and advantage of the present invention is its ability to provide a mixing cap that may be loaded at time of initial consumer use.

Yet another feature and advantage of the present invention is its ability to provide a mixing cap, the contents of which may be introduced or discharged into a bottle by simply depressing the mixing cap.

Yet another feature and advantage of the present invention is its ability to allow selective introduction of various ingredients stored in separate compartments into a bottle.

Yet another feature and advantage of the present invention is its ability to allow simultaneous introduction of different ingredients stored in separate compartments into a bottle.

Yet another feature and advantage of the present invention is its ability to allow sequential introduction of one or more ingredient(s) into a bottle.

These and other features and advantages of the invention will become more apparent to one ordinarily skilled in the art from the following description of the invention and claims when read in light of the accompanying drawings.

BRIEF DESCRIPTION OF THE DRAWINGS

The present invention will be better understood by reading the Detailed Description of the Invention with reference to the accompanying drawing Figures, in which like reference numerals denote similar structure and refer to like elements throughout, and in which.

DETAILED DESCRIPTION OF THE INVENTION

In describing the various selected embodiments of the present invention, as illustrated in FIGS. 1-34, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIG. 1-7, Mixing cap 10 preferably comprises outer housing 20 and inner tube 40. Mixing cap 10 is preferably formed from a suitable plastic substrate, such as, for exemplary purposes only, polyethylene terephthalate (PET), and with sufficient structural rigidity to prevent deformation, breakage and/or tearing of same during implementation of the present method. Accordingly, outer housing 20 and inner tube 40 are preferably formed via blow molding processes, injection molding processes, extrusion processes, casting processes, milling processes, stamping processes, or the like, but may be manufactured according to any suitable process so long as the functions described herein are enabled. Additionally, during time of manufacture, and preferably prior to assembly of mixing cap 10, outer housing 20 may be pre-loaded with one or more selected dry or liquid ingredient(s) to facilitate subsequent consumer use; however, and as more fully described below, it is contemplated that outer housing 20 may be loaded with one or more selected ingredient(s) at time of initial consumer use, or at any time therebetween (i.e., post-manufacture and/or assembly of mixing cap 10). It should be recognized that other suitable materials or substrates may be utilized to form mixing cap 10, such as, for exemplary purposes only, metals, metal alloys, ceramics, natural and/or synthetic rubbers, combinations thereof, or the like.

Figure 1:
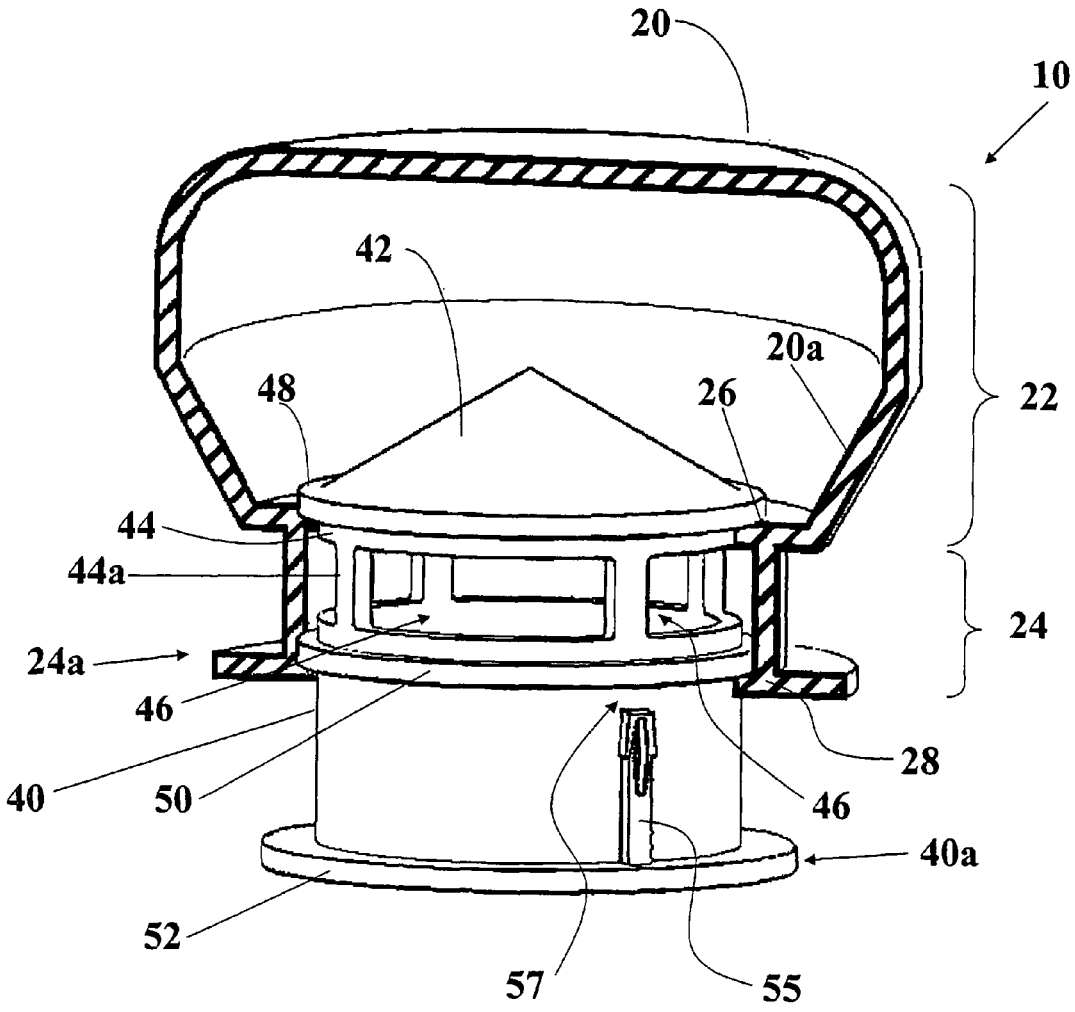
FIG. 1 is a partial cross-sectional side perspective view of a mixing cap according to the present invention.

Referring now more specifically to FIG. 1, outer housing 20 comprises a substantially cylindrical configuration defined by upper storage receptacle 22 and lower neck portion 24, wherein storage receptacle 22 preferably contains the selected dry or liquid ingredient for introduction into, and mixture with, the contents of bottle B, as more fully described below.

Medial flange 26 may be formed on and around inner wall 20*a* of outer housing 20, between storage receptacle 22 and neck portion 24 thereof. Additionally, base flange 28 may be disposed on and around base 24*a* of neck portion 24, wherein base flange 28 extends radially inward of base 24*a* and radially outward of base 24*a*. As more fully described below, base flange 28 preferably interacts with a ridge arrangement formed on inner tube 40 and, thus, operatively controls and restricts axial movement between outer housing 20 and inner tube 40.

Inner tube 40 preferably comprises peaked or dome-shaped top wall 42, preferably integrally formed with hollow, cylindrical-shaped sidewall 44, wherein sidewall 44 preferably comprises one or more aperture 46 formed therethrough, proximate top wall 42. Upper flange 48 may be formed on and around exterior surface 44*a* of sidewall 44, proximate top wall 42. Likewise, medial flange 50 may be disposed on and around exterior surface 44*a* of sidewall 44 proximate apertures 46. Similarly, base flange 52 may be disposed on and around exterior surface 44*a* of sidewall 44 proximate base 40*a* of inner tube 40. Ridge 55 preferably extends axially, at least partially, between base flange 52 and medial flange 50, over exterior surface 44*a* of sidewall 44, and may terminate at a distance below medial flange 50, thereby defining gap 57 between ridge 55 and medial flange 50. Preferably gap 57 is sufficiently large so as to allow base flange 28 to pass therethrough, such as during rotation of outer housing 20 with respect to inner tube 40. That is to say that the size of gap 57 is preferably substantially equivalent to the thickness T of base flange 28. Thus, inner tube 40 may be free to rotate relative to outer housing 20, with base flange 28 passing through gap 57, but inner tube 40 may not be free to slide axially with respect to outer housing 20 when ridge 55 engages base flange 28.

Figure 2:
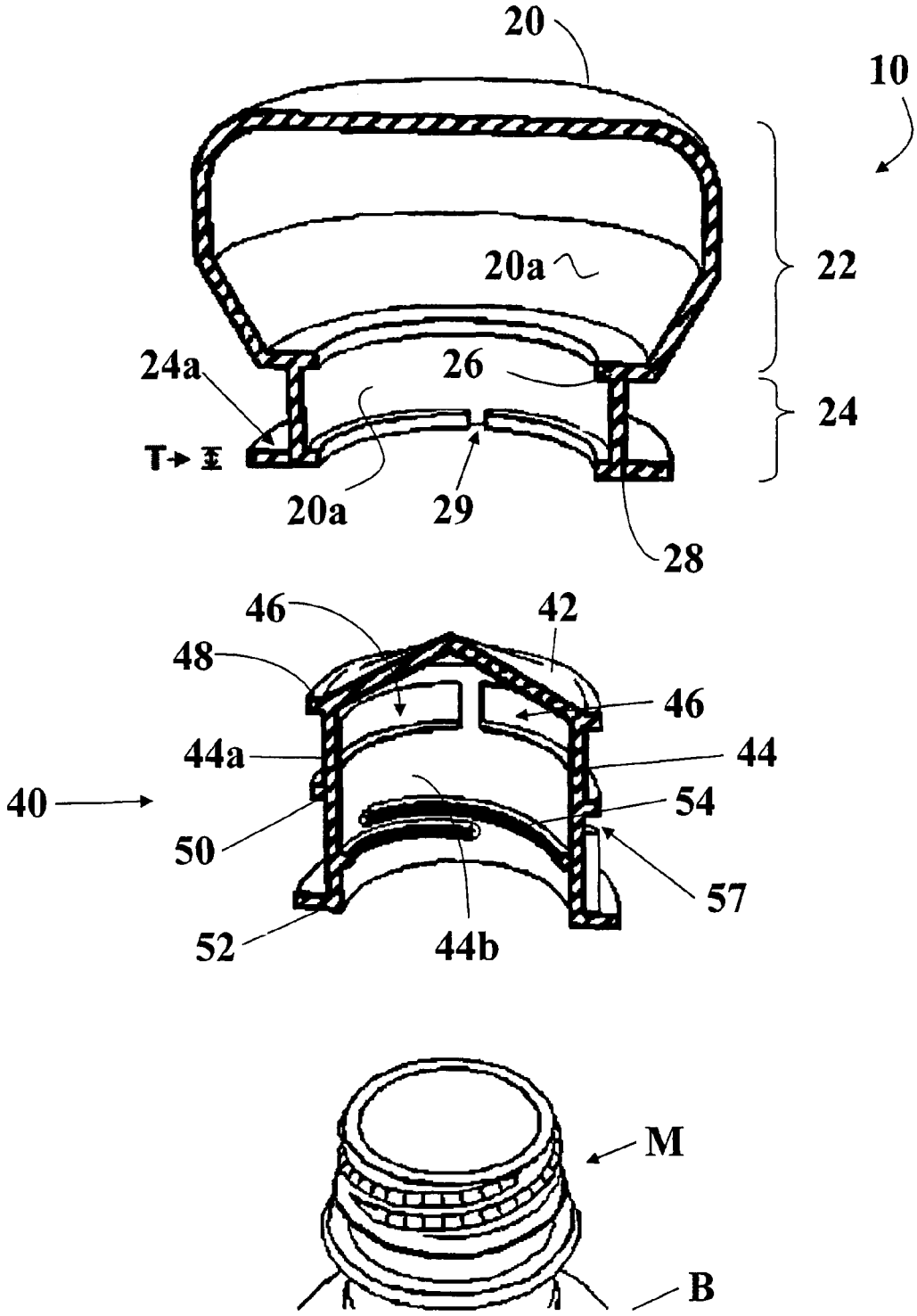
FIG. 2 is an exploded partial cross-sectional side perspective view of a mixing cap according to the present invention.
Figure 3:
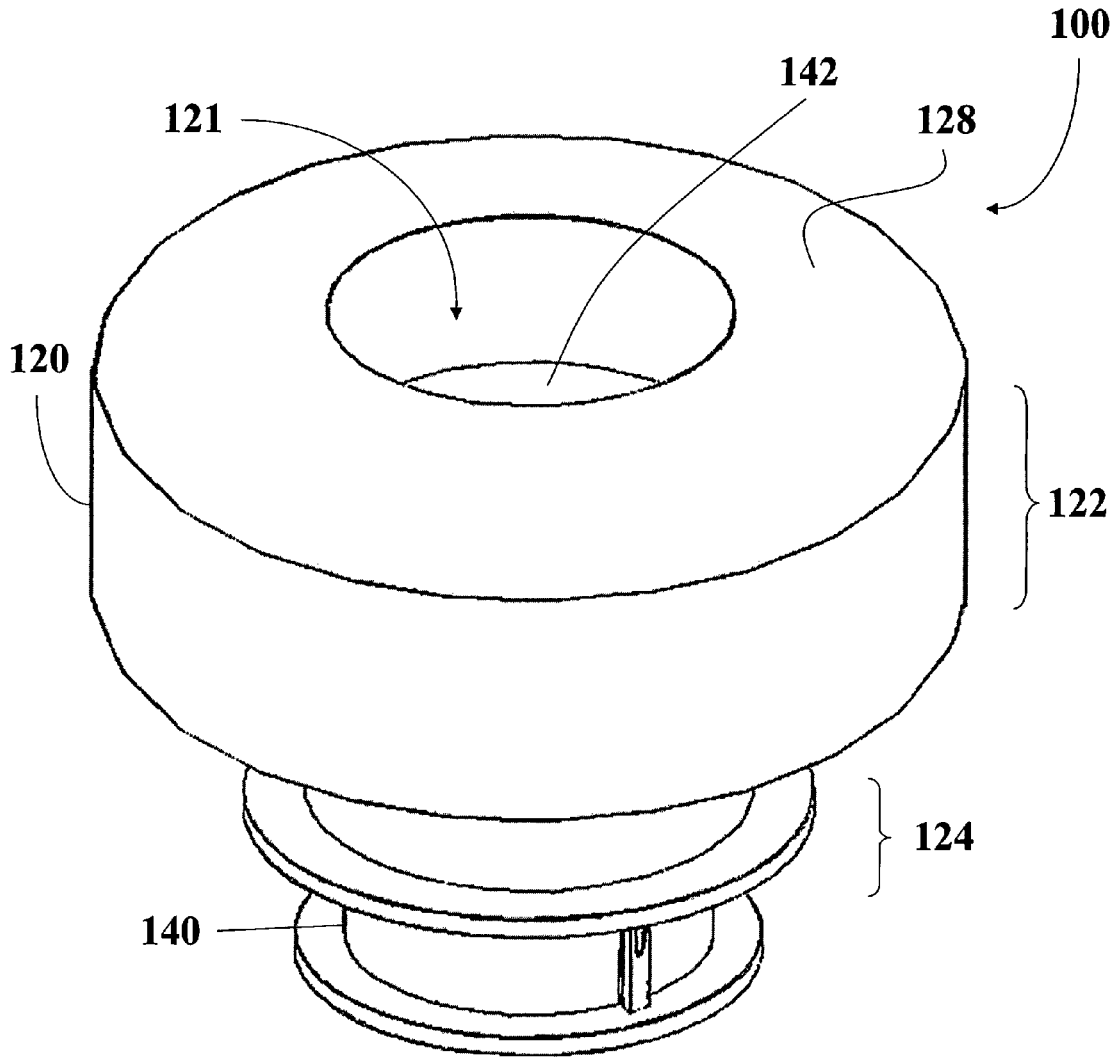
FIG. 3 is a perspective view of a mixing cap according to the present invention.
Figure 4:
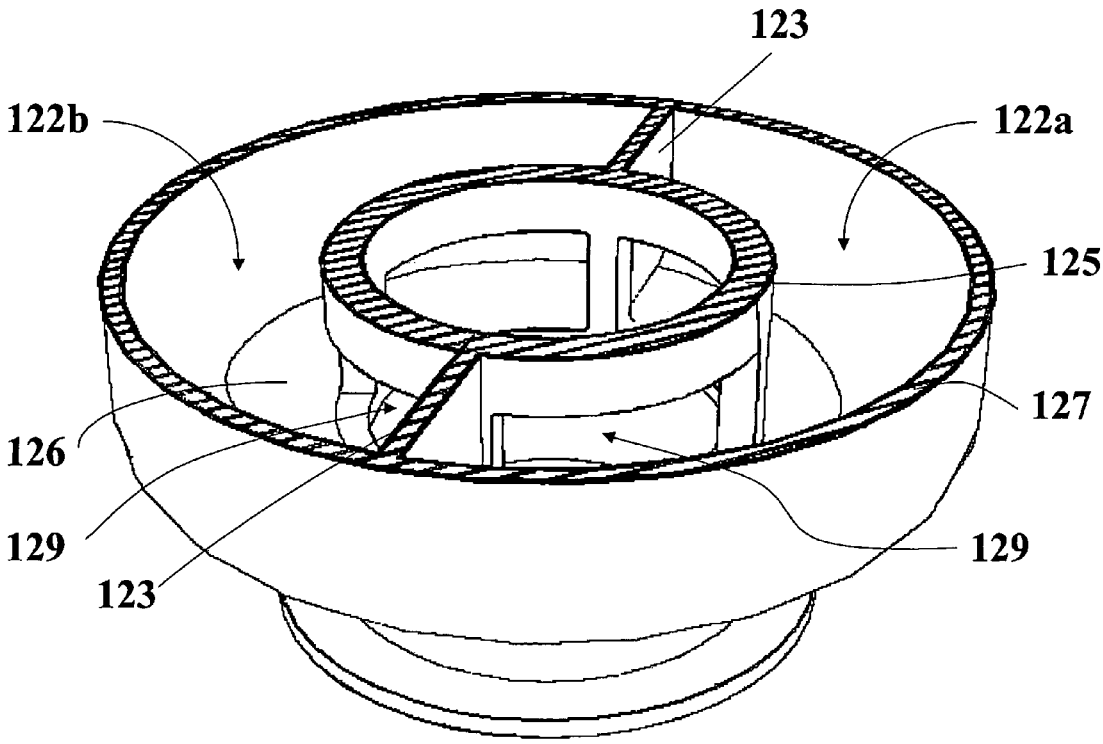
FIG. 4 is a cross-sectional perspective view of a mixing cap according to the present invention, shown in a closed or inactive position.
Figure 5:
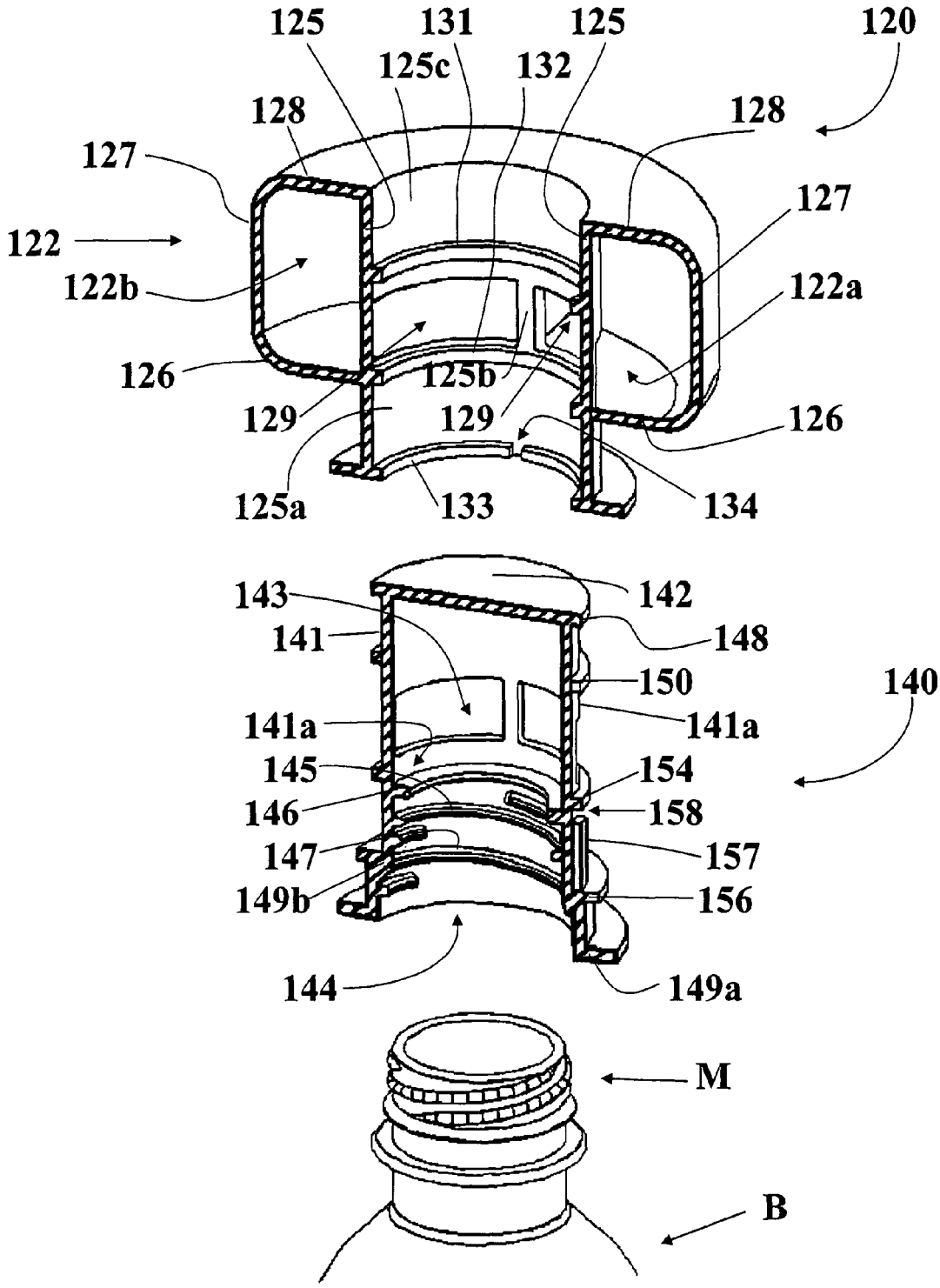
FIG. 5 is a cross-sectional exploded perspective view of a mixing cap according to the present invention.

Referring now more specifically to FIG. 2, with continued reference to FIG. 1, base flange 28 preferably includes slot 29 disposed axially therethrough. Slot 29 is preferably configured to allow passage of ridge 55 therethrough, at least when aligned therewith. As such, slot 29 preferably allows outer housing 20 to slide axially over inner tube 40 when ridge 55 and slot 29 are aligned. When ridge 55 and slot 29 are not aligned, however, ridge 55 and base flange 28 preferably cooperate to prevent relative axial motion between inner tube 40 and outer housing 20. Thus, ridge 55 and slot 29 preferably cooperate to provide means for preventing accidental, inadvertent, premature, or otherwise unwanted opening, of mixing cap 10 and/or dispensing of contents contained therein.

When mixing cap 10 is in a "closed position", i.e. when ridge 55 is not aligned with slot 29 and when openings 46 are disposed below medial flange 26, the pre-loaded ingredients or contents are maintained within storage receptacle 22 of outer housing 20 by virtue of dome-shaped top wall 42 and upper flange 48 of inner tube 40 functioning as an effective seal between storage receptacle 22 and the interior of hollow cylindrical sidewall 44. In such a configuration, upper flange 48 of inner tube 40 is preferably positioned above and bears against inner medial flange 26 of outer housing 20. Medial flange 50 of inner tube 40 is preferably likewise seated on inner base flange 28 of outer housing 20. Additionally, in such a closed position, apertures 46 of sidewall 44 of inner tube 40 are preferably disposed proximate, and covered by, inner wall 20*a* of base 24*a* of outer housing 20. It will be understood, however, that one or more of upper flange 48, medial flange 50, and base flange 52 may be modified or eliminated, so long as a sufficient seal is provided between storage receptacle 22 and the interior of hollow cylindrical sidewall 44.

Additionally, threading 54 is preferably formed on lower inner surface 44*b* of sidewall 44 (see FIG. 2). Threading 54 preferably enables inner tube 40, and mixing cap 10 generally, to be threadably-engaged with mouth M of bottle B, such as a conventional personal-sized water bottle, or other liquid-containing bottle, as best illustrated in FIG. 2. Although, mixing cap 10 is preferably threadably-engaged to mouth M of bottle B, it should be recognized that the technology of the present invention may be appropriately modified to accommodate various structural properties of any selected bottle, including, without limitation, mouth diameter, flanged configuration (e.g. flanged mouths), threaded or unthreaded mouths, combinations thereof, or the like. As such, it is contemplated that mixing cap 10 may be coupled to an unthreaded mouth of a bottle via frictional-fit, such as via a conformable rubber gasket, or other sealing device.

Referring now more specifically to FIGS. 3-7, mixing cap 100 preferably includes outer housing 120 comprising toroidal storage receptacle 122 and hollow cylindrical neck portion 124. Inner tube 140 is preferably slidably engaged therewith within central opening 121 of outer housing 120, and is preferably slidably restricted therewithin, such as by a flange arrangement similar to that of mixing cap 10, discussed in more detail below.

Toroidal storage receptacle 122 is preferably formed by cylindrical inner wall 125 (which surrounds and defines central opening 121), cylindrical outer wall 127, bottom wall 126, and top wall 128. Cylindrical inner wall 125 and cylindrical outer wall. 127 are preferably concentrically arranged, with bottom wall 126 and top wall 128 extending therebetween at the top portions and bottom portions, respectively.

Cylindrical inner wall 125 preferably extends below bottom wall 126 and defines hollow cylindrical neck portion 124.

Toroidal storage receptacle 122 is preferably divided into a plurality of, such as two, chambers 122*a* and 122*b* by partitions 123 disposed radially between cylindrical inner wall 125 and cylindrical outer wall 127 and axially between bottom wall 126 and top wall 128. Each of chambers 122*a* and 122*b* preferably includes at least one opening 129 disposed in cylindrical inner wall 125 for providing access to the respective chamber.

Cylindrical inner wall 125 preferably includes inner medial flange 131, lower flange 132, and base flange 133 disposed on interior surface 125*a* thereof. Inner medial flange 131 is preferably disposed generally midway between top wall 128 and bottom wall 126 and divides cylindrical inner wall into upper section 125*c* and lower section 125*b*. Openings 129 are preferably disposed in lower section 125*b*. Lower flange. 132 is preferably disposed proximate bottom wall 126. Base flange 133 is preferably disposed proximate a lower end of hollow cylindrical neck portion 124 and preferably includes slot 134 disposed axially therethrough.

Inner tube 140 is preferably formed of hollow cylindrical wall 141 with top wall 142 closing an end thereof. Upper flange 148 is preferably disposed proximate top wall 142 on exterior surface 141*a* of cylindrical wall 141. Medial flange 150 is preferably disposed on exterior surface 141*a* proximate opening 143 disposed in hollow cylindrical wall 141 between opening 143 and top wall 142. Lower flange 154 is preferably disposed on exterior surface 141*a* proximate opening 143 on an opposite side thereof with respect to medial flange 150, such that opening 143 is positioned between medial flange 150 and base flange 154. Base flange 156 is preferably disposed proximate open end 144 of inner cylinder 140. Ridge 157 preferably extends axially at least partially between base flange 156 and lower flange 154 such that gap 158 is defined between ridge 157 and lower flange 154.

Inner tube 140 preferably further includes threads 145 and 147 disposed on interior surface 141*a*. Threads 145 and 147 are preferably configured and arranged to operably engage mouth M of a specific type of bottle B. Preferably, threads 145 have dimensions and specifications adapted to engage the standard threads T of a bottle B having a mouth M having a circumference adapted to fit within and engage lower portion 149*b* of hollow cylindrical wall 141. Similarly, threads 147 preferably have dimensions and specifications adapted to engage the standard threads T of bottle B having mouth M having a circumference adapted to fit within and engage base section 149*a*. Stop 146 may be included proximate threads 145 whereby an upper exterior portion of mouth M may abut thereagainst to create a seal between mixing cap 100 and bottle B.

Figure 6:
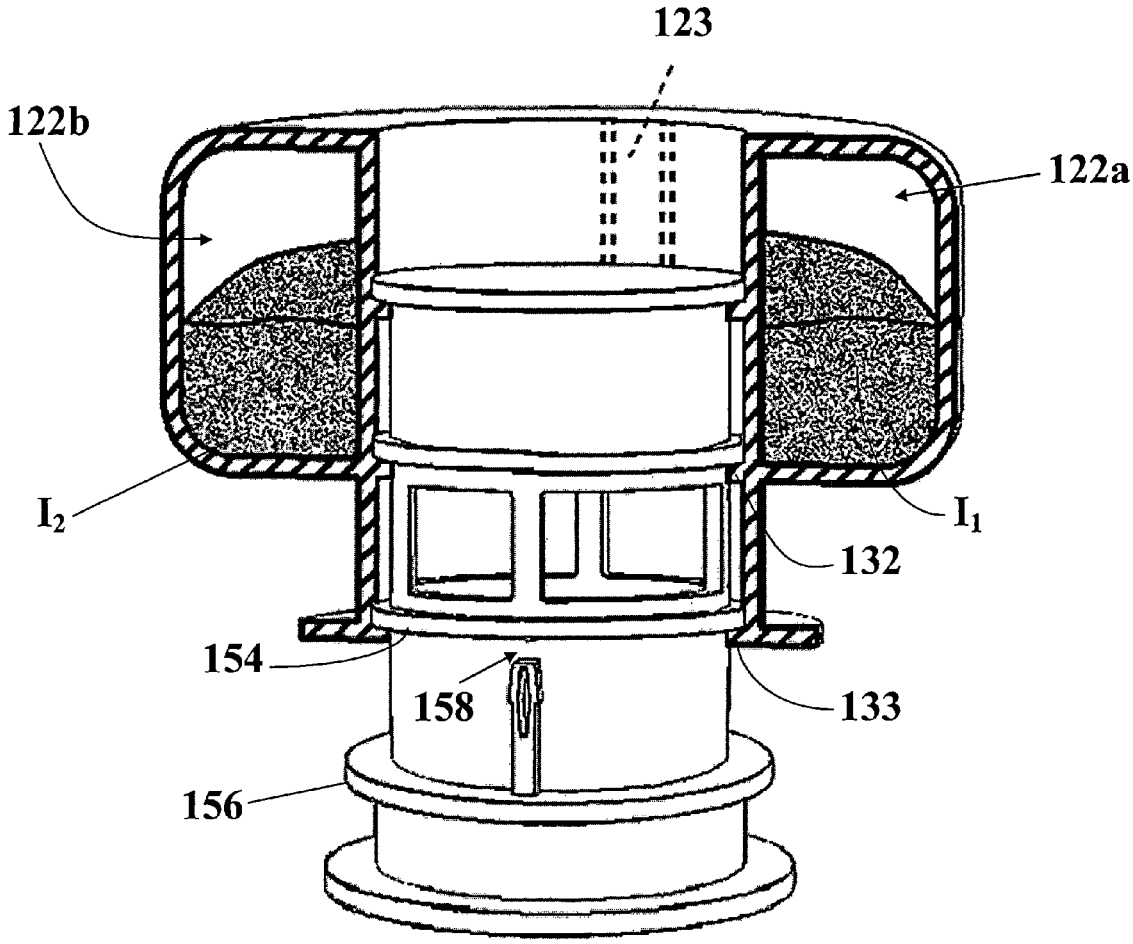
FIG. 6 is a partial cross-sectional perspective view of a mixing cap according to the present invention, shown in a closed position.
Figure 7:
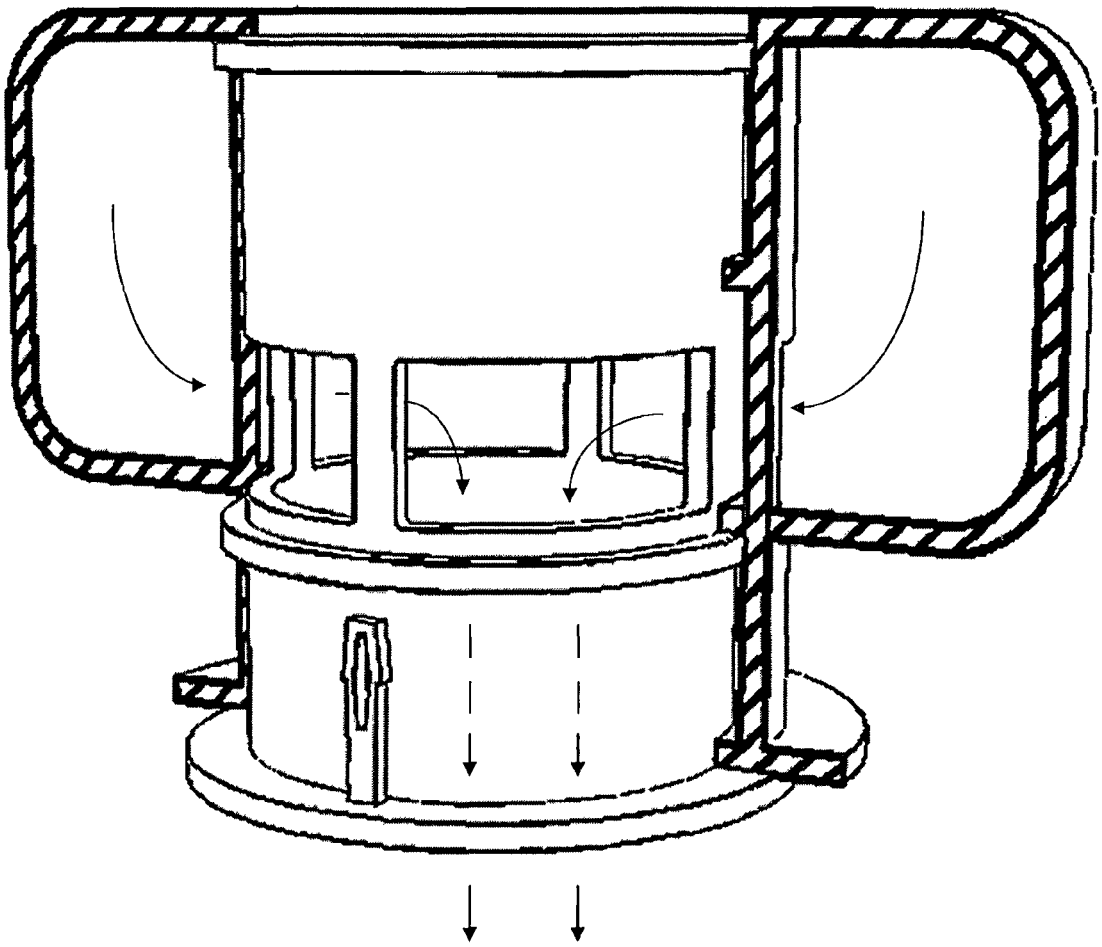
FIG. 7 is a partial cross-sectional perspective view of a mixing cap according to the present invention, shown in an open position.
Figure 8:
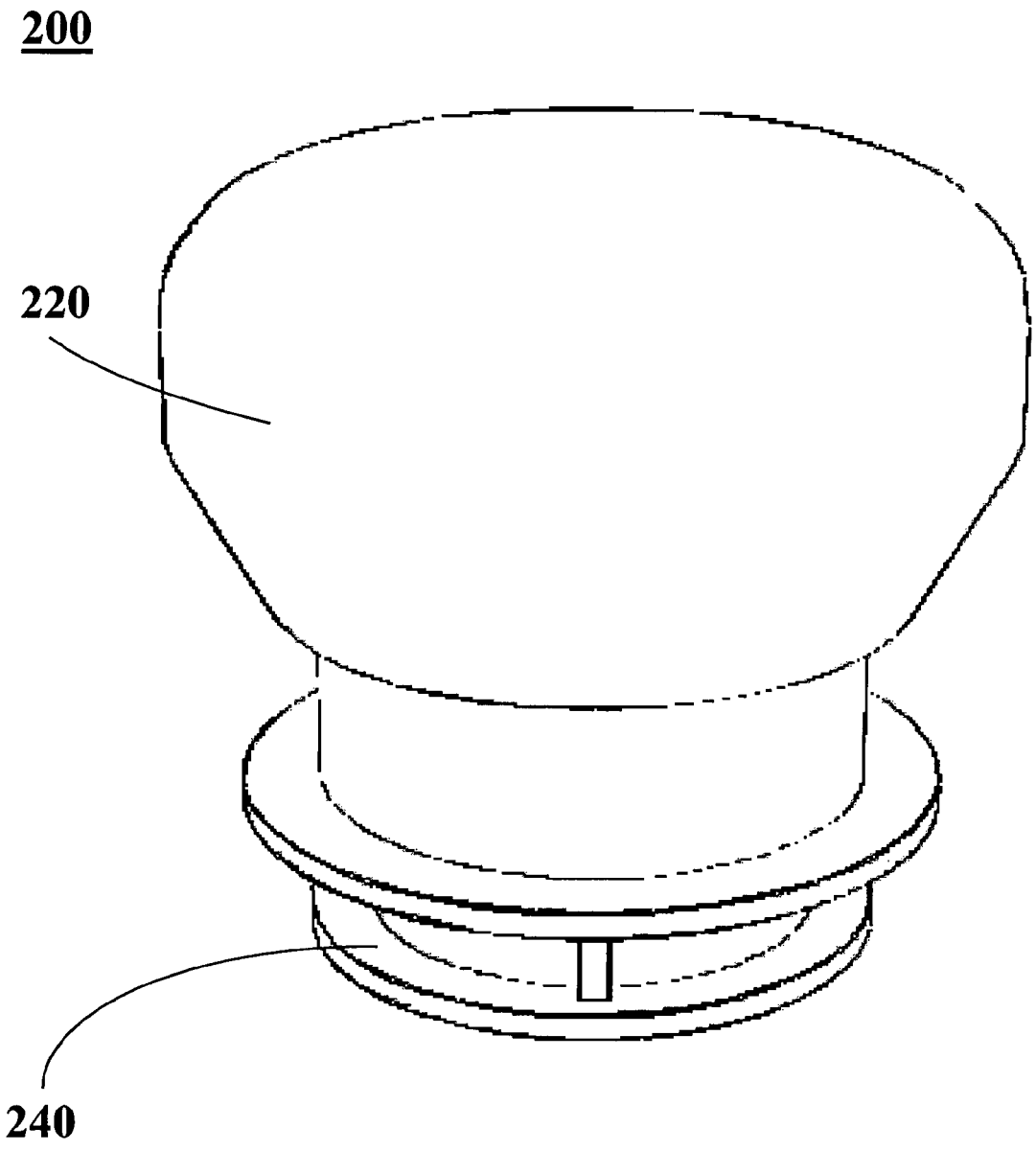
FIG. 8 is a perspective view of a mixing cap according to the preferred embodiment of the present invention.
Figure 9:
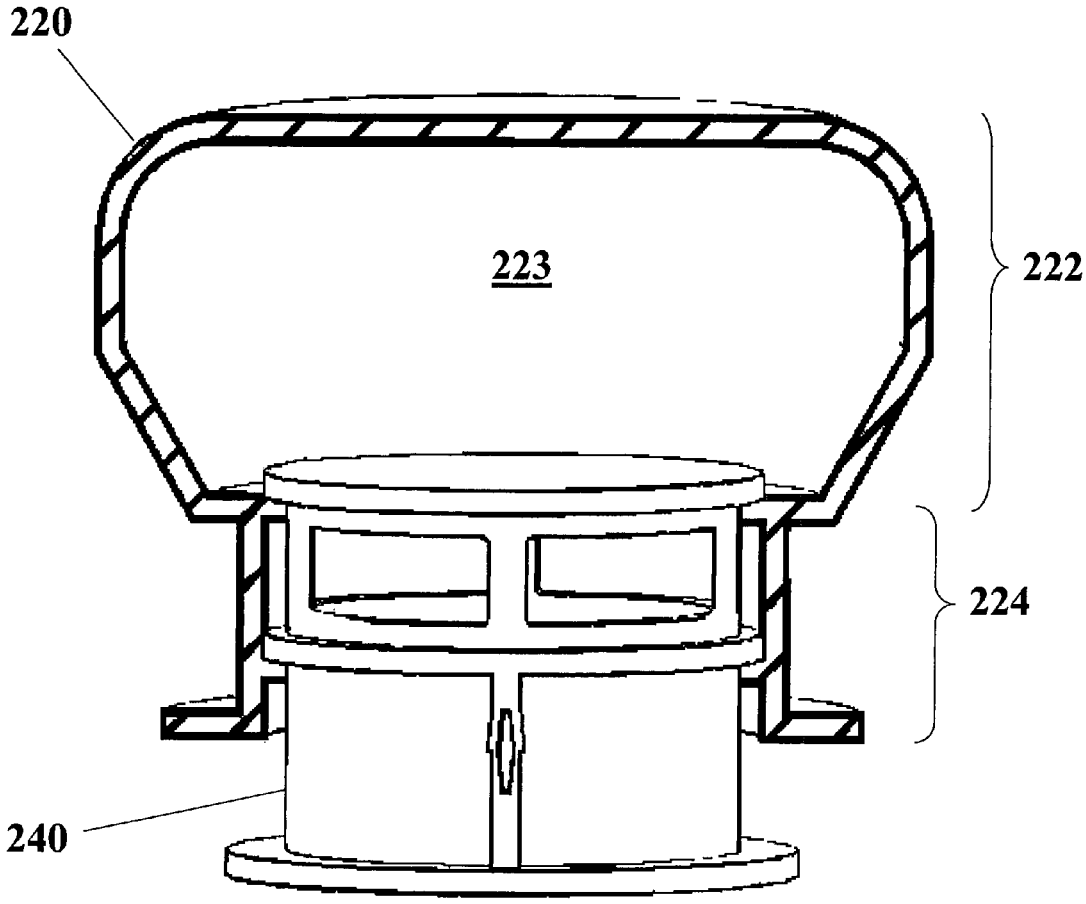
FIG. 9 is a partial cross-sectional side view of the mixing cap of FIG. 8.
Figure 10:
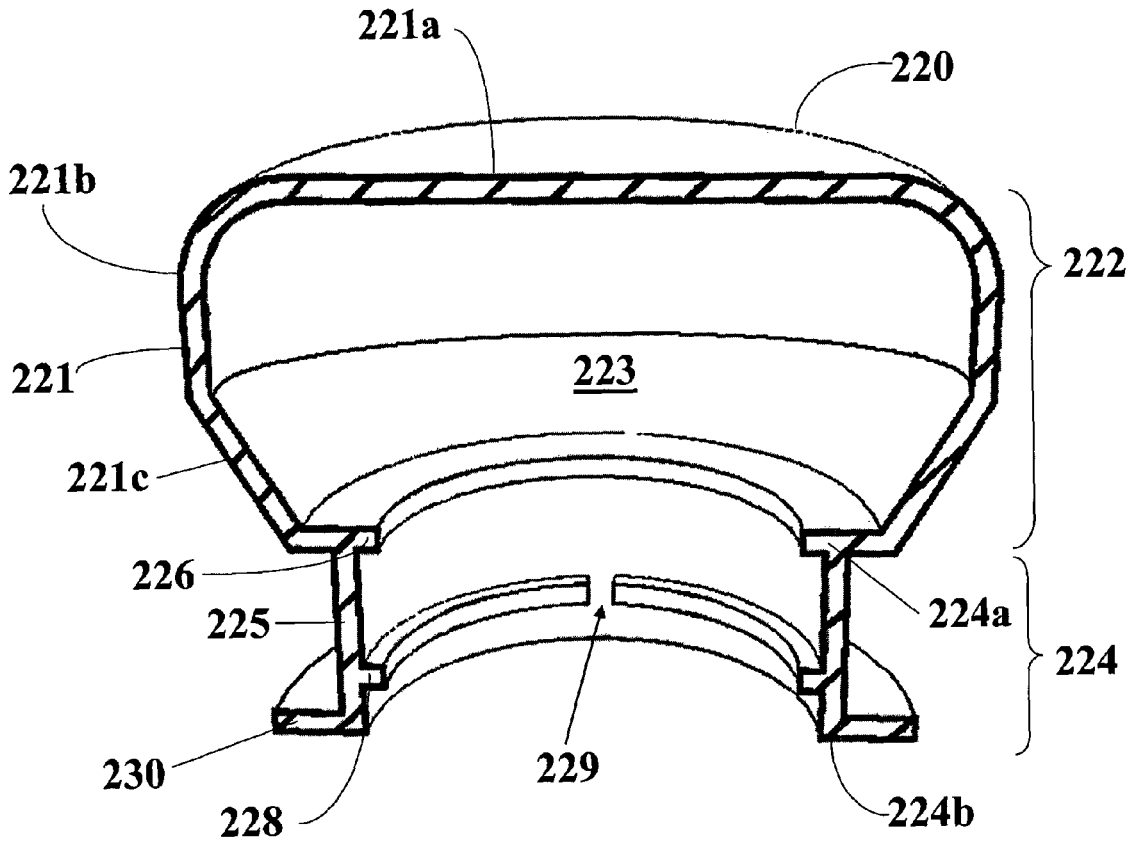
FIG. 10 is a cross-sectional view of an outer housing of the mixing cap.
Figure 11:
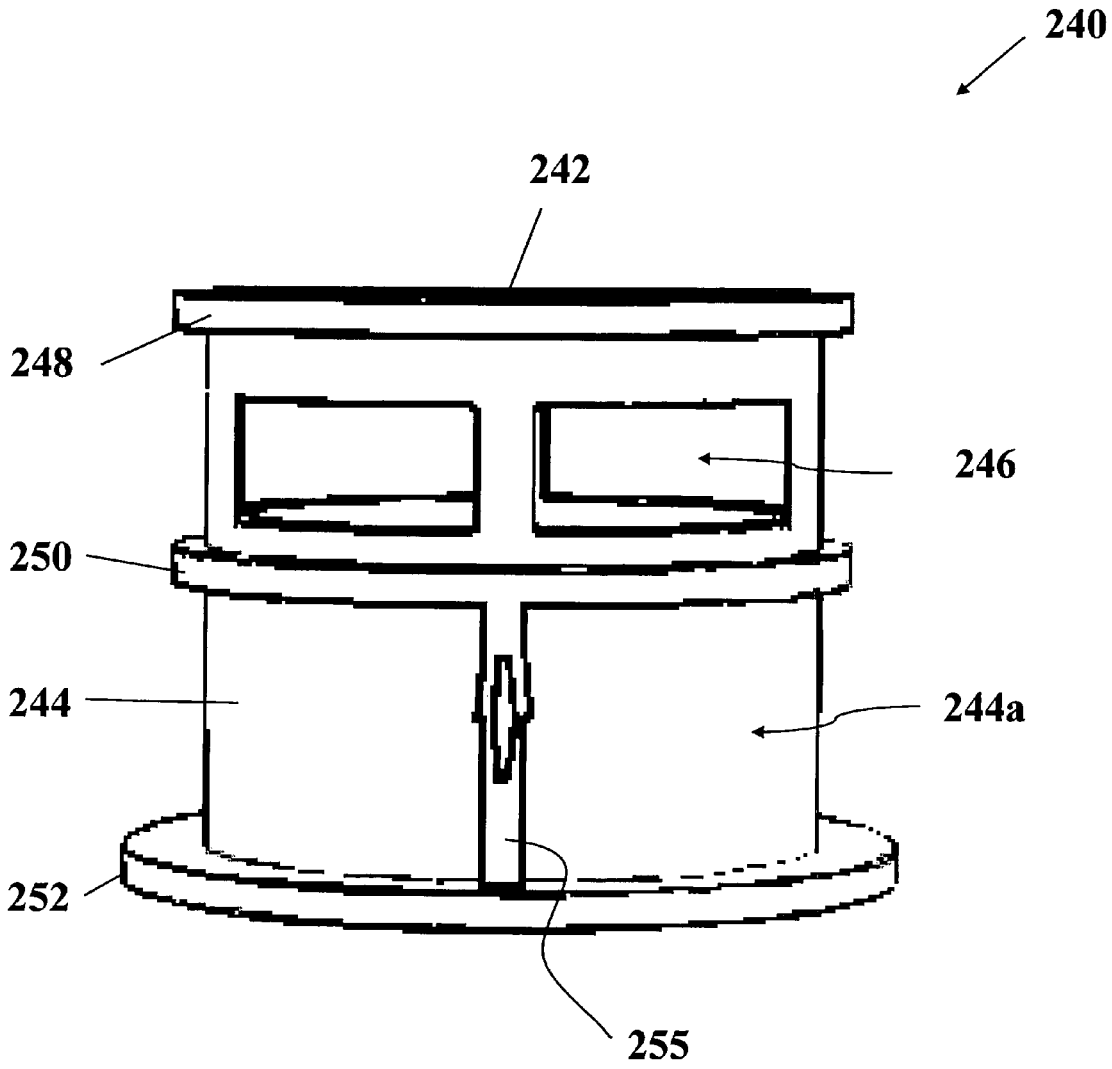
FIG. 11 is a perspective view of an inner tube of the mixing cap of FIG. 10.
Figure 12:
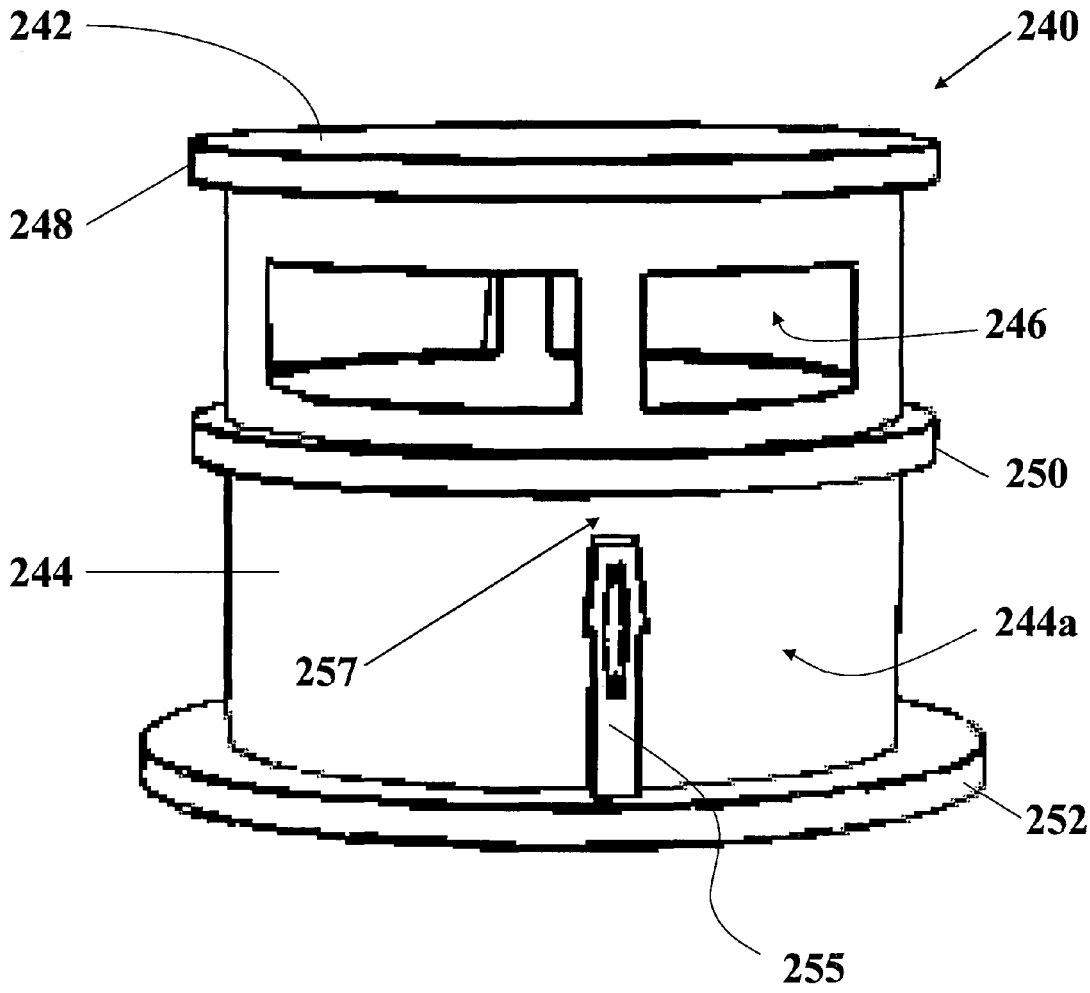
FIG. 12 is a perspective view of an alternative inner tube of the mixing cap of the present invention.

In use, mixing cap 100 is preferably initially arranged in a closed position, as shown in FIG. 6, with ingredient $I_1$ contained within storage compartment 122*a*, and ingredient $I_2$ contained within storage compartment 122*b*. In the closed position, upper flange 148 is preferably disposed proximate medial flange 131 with medial flange 131 preferably disposed between upper flange 148 and medial flange 150. Similarly, medial flange 150 is preferably disposed proximate lower flange 132 such that lower flange 132 is preferably disposed between medial flange 150 and lower flange 154. Again similarly, lower flange 154 is preferably disposed proximate base flange 133 with base flange 133 preferably disposed between lower flange 154 and base flange 156.

Furthermore, in the closed position, openings 129 are preferably disposed proximate hollow cylindrical wall 141, such as between top flange 148 and medial flange 150, such that ingredients $I_1$ and $I_2$ are prevented from substantially flowing out of chambers 122*a* and 122*b*, respectively. In addition, openings 143 are preferably disposed proximate cylindrical inner wall 125 at hollow cylindrical neck portion 124 such that the contents of bottle B may be prevented from substantially flowing out of bottle B. Finally, base flange 133 is preferably rotatably engaged with gap 158 such that outer housing 120 may rotate about inner tube 140. Outer housing 120 is preferably rotatable relative to inner tube 140 such that ridge 157 is disposed proximate to and abutting base flange 133 and not in alignment with slot 134. Thus, in the closed position, ingredients $I_1$ and $I_2$ are isolated from bottle B, and outer housing 120 is prevented from sliding axially relative to inner tube 140.

In order to place mixing cap 110 into an "open position", so that dry or liquid ingredients $I_1$ and $I_2$ of storage receptacle 122 of outer housing 120 may preferably be introduced or discharged into communicating bottle B, outer housing 120 is preferably rotated about inner housing 140 to align ridge 157 with slot 134. When such alignment is attained, outer housing 120 may preferably be sufficiently depressed to downwardly slide neck portion 124 thereof over hollow cylindrical sidewall 141 of inner tube 140. Such downward sliding of outer housing 120 preferably results in upper flange 148 sliding to a position proximate to top wall 128, medial flange 150 sliding to a position proximate to and abutting medial flange 131, lower flange 154 sliding to a position proximate to and abutting lower flange 132, and base flange 156 sliding to a position proximate to and abutting base flange 133. Such sliding preferably further results in openings 129 being disposed proximate openings 143 such that ingredients $I_1$ and $I_2$ may flow into bottle B, and preferably mix with the contents thereof. Mixing cap 100 may preferably be attached to bottle B such that bottle B may preferably be inverted, thereby allowing the contents thereof, such as a liquid, to flow into storage receptacle 122 to facilitate complete mixing of ingredients $I_1$ and $I_2$ with the contents of bottle B.

According to one embodiment, compartments 122*a* and 122*b* of storage receptacle 122 are separately selectively operable to allow for sequential introduction of ingredients $I_1$ and $I_2$ into bottle B, such as via guide means. Preferably, such separate selective opening of compartments 122*a* and 122*b* is accomplished by including two slots 134 in base flange 133 such that outer housing 120 is slidable relative to inner tube 140 when ridge 157 is aligned with either one of slots 134. Preferably opening 143, or each of openings 143 if more than one is included, is disposed in hollow cylindrical wall 141 such that when ridge 157 is aligned with a given one of slots 134 and outer housing 120 is slid over inner tube 140, opening 143 is preferably only disposed proximate opening 129 associated with a single one of compartments 122*a* and 122*b*. Similarly, when ridge 157 is aligned with the other of slots 134 and housing 120 is slid over inner tube 140, opening 143 is preferably disposed only proximate opening 129 associated with the other of compartments 122*a* and 122*b*. In this way, mixing cap 100 may be used to selectively sequentially dispense ingredients $I_1$ and $I_2$ into bottle B. Thus, mixing cap 100 may be used to mix two doses of a selected nutritional supplement, medicine, flavored beverage, combinations thereof, or the like, or to mix a single dose each of two different nutritional supplements, medicines, flavored beverages, combinations thereof, or the like.

Now referring to FIGS. 8-14*b*, mixing cap 200 comprises outer housing 220 and inner tube 240. Outer housing 220 preferably comprises upper portion 222 and lower portion 224. Upper portion 222 preferably includes storage receptacle 223 while lower portion 224 preferably engages inner tube 240 and provides a neck through which contents may be discharged. Storage receptacle 223 is preferably formed by sidewall 221 preferably defining top 221*a*, side 221*b*, and tapered portion 221*c*, thereby forming a generally enclosed container having an open bottom (the bottom being closed by inner tube 240, as described in more detail below). Upper flange 226 is preferably disposed around an interior of proximal end 224*a* of lower portion 224, proximate upper portion 222. Medial flange 228 is preferably disposed around an interior of lower portion 224 distal upper flange 226, and preferably includes slot 229 formed therein. Base flange 230 is preferably disposed about distal end 224*b* of lower portion 224.

Figure 13:
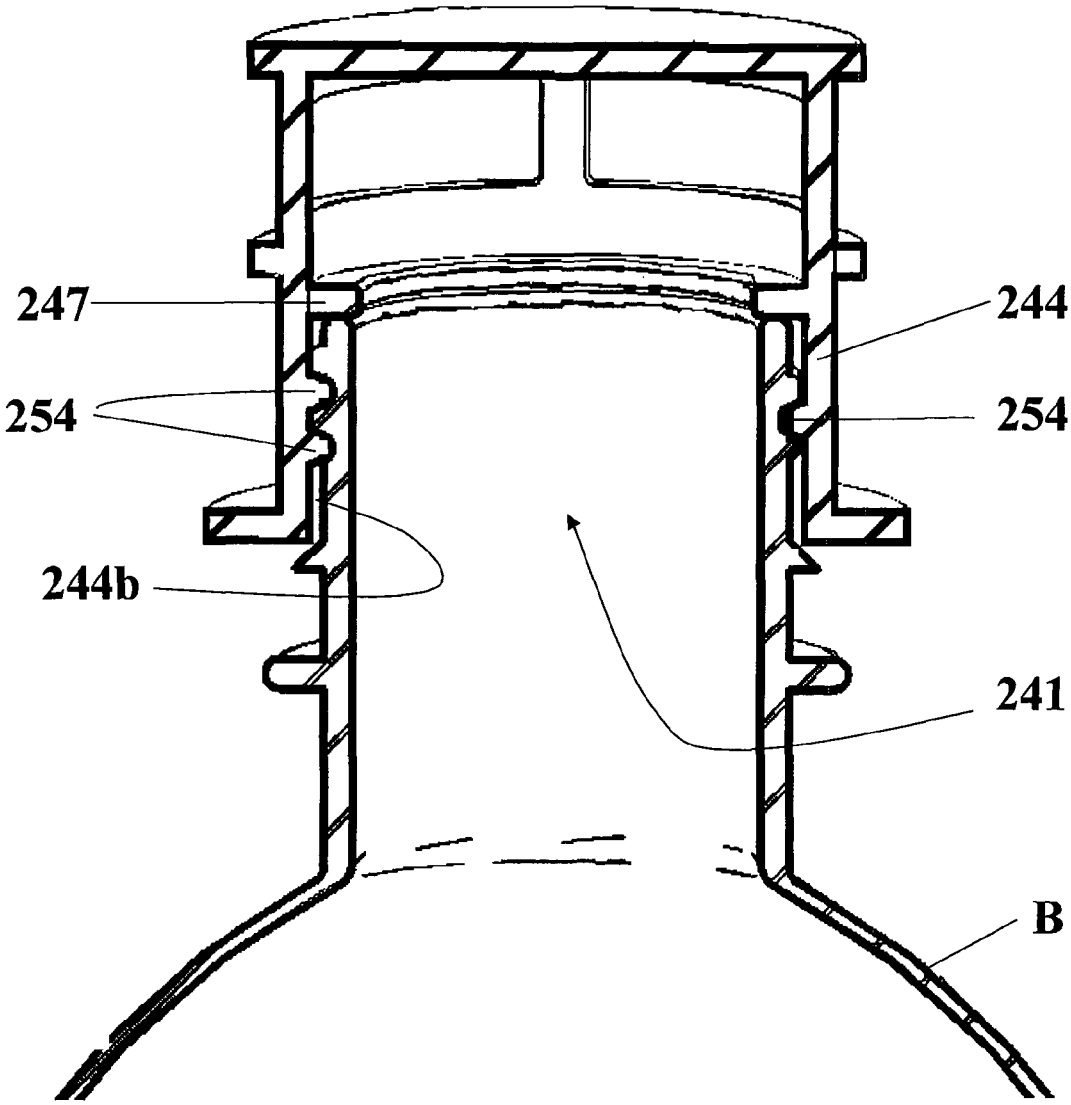
FIG. 13 is a cross-sectional perspective view of the inner tube of FIG. 11 attached to a bottle.

Inner tube 240 preferably comprises top wall 242, such as a flat or peaked wall, extending within the open bottom of storage receptacle 223 (as seen in FIG. 13), thereby sealing storage receptacle 223. Such sealing is preferably accomplished via an abutting relationship of upper flange 248 of inner tube 240 and upper flange 226 of outer housing 220 and/or via an abutting relationship of upper flange 226 with sidewall 244, or the like. Upper flange 248 is preferably disposed on and around exterior 244*a* of sidewall 244 proximate top wall 242. Cylindrical sidewall 244 preferably depends from top wall 242, preferably near a peripheral edge thereof and preferably includes one or more aperture 246 disposed therethrough, proximate top wall 242. Sidewall 244 is preferably sized so as to mate with lower portion 224 of outer housing 220. Preferably, such mating is accomplished by an abutting relationship of sidewall 244 and one or more of upper flange 226 and medial flange 228. Furthermore, medial flange 250 is preferably formed on and around exterior surface 244*a* of sidewall 244 distal aperture 246, thereby sealing aperture 246 between upper flange 246 preferably engaged with upper flange 226 and/or sidewall 225 of lower portion 224 and medial flange 250 preferably engaged with medial flange 228 and/or sidewall 225 of lower portion 224.

In use, mixing cap 200 may preferably be opened by sliding outer housing 220 over inner tube 240 such that upper flange 226 is preferably moved out of an abutting relationship with upper flange 248 and/or sidewall. 244. Such sliding preferably exposes at least a portion of one or more aperture 246 to storage receptacle 223, whereby contents stored within storage receptacle 223 may preferably move, such as due to gravity, agitation, or the like, through at least one aperture 246 into hollow interior 241 of inner tube 240, whereby it may mix with contents of bottle B attached to mixing cap 200, such as by threads 254 disposed on interior surface 244*b* of sidewall 244. Again, bottle B may preferably be inverted so as to allow the contents thereof to flow into storage receptacle 223, thereby facilitating complete mixing of the respective contents of storage receptacle 223 and bottle B. Furthermore, interior surface 244*b* of sidewall 244 may include stop 247 adapted to engage an upper edge of mouth M of bottle B, and thereby to provide an effective seal, such that any contents of bottle B and/or mixing cap 200 may not escape or spill.

Preferably, such sliding takes the form of depressing outer housing 220 relative to inner tube 240 and is preferably constrained by the interaction of one or more pairs of flanges, such as an abutting interaction of upper flange 226 with medial flange 250, an abutting relationship of medial flange 228 and/or distal end 224*b* with base flange 252 disposed on and around exterior surface 244*a* of sidewall 244 proximate a distal end thereof. Alternatively, such sliding may be constrained by the interaction of other structures of outer housing 220 and inner tube 240, such as an interaction of top wall 242 with a top of storage receptacle 223, or the like.

Figure 14A:
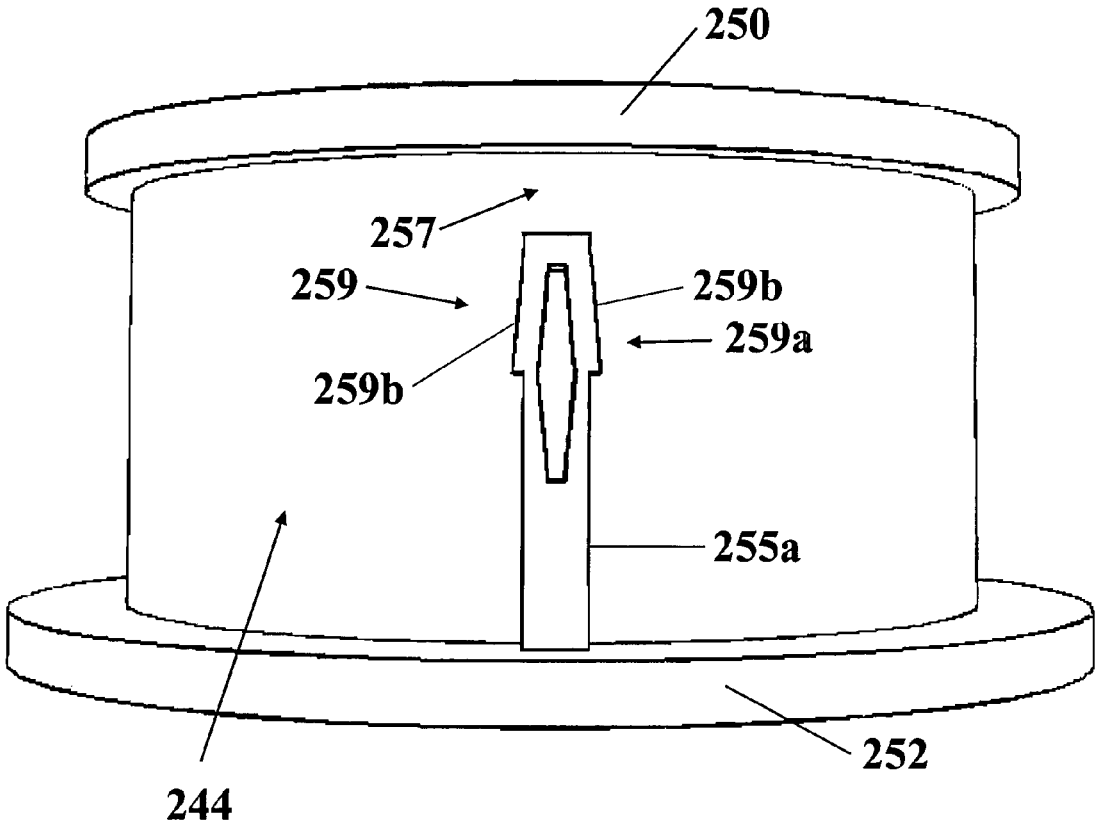
FIG. 14*a* is a front view of a control means of the mixing cap of the present invention for controlling selective operation thereof.
Figure 14B:
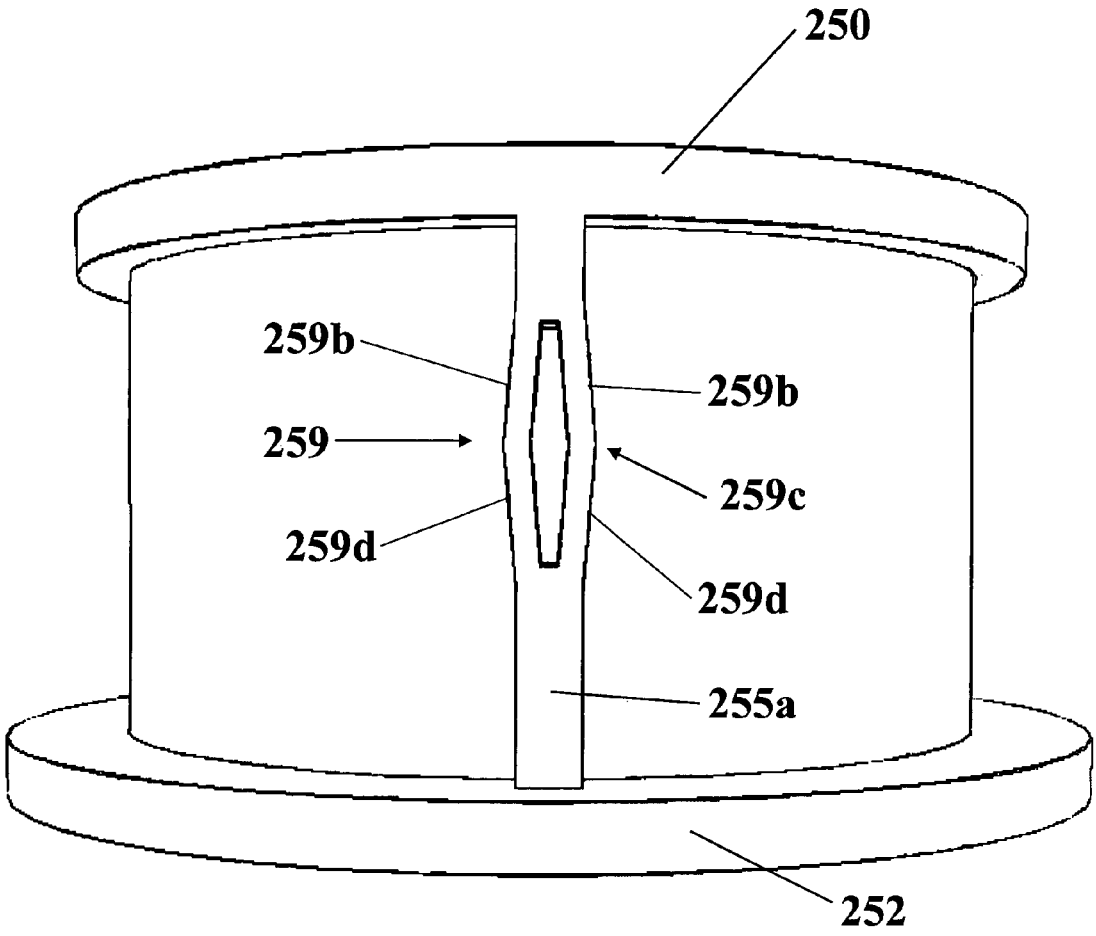
FIG. 14*b* is a front view of an alternate control means of the mixing cap of the present invention.
Figure 15:
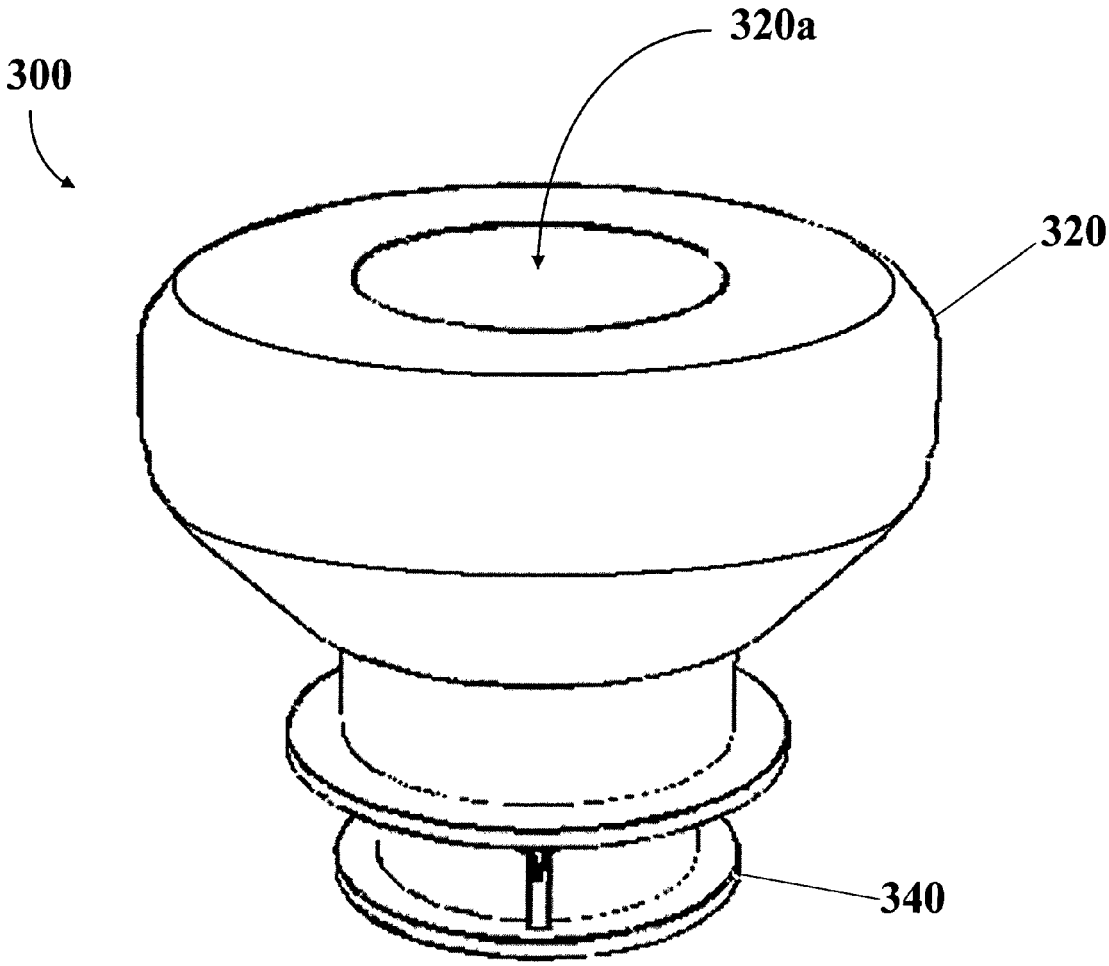
FIG. 15 is a perspective view of a mixing cap according to the present invention.
Figure 16:
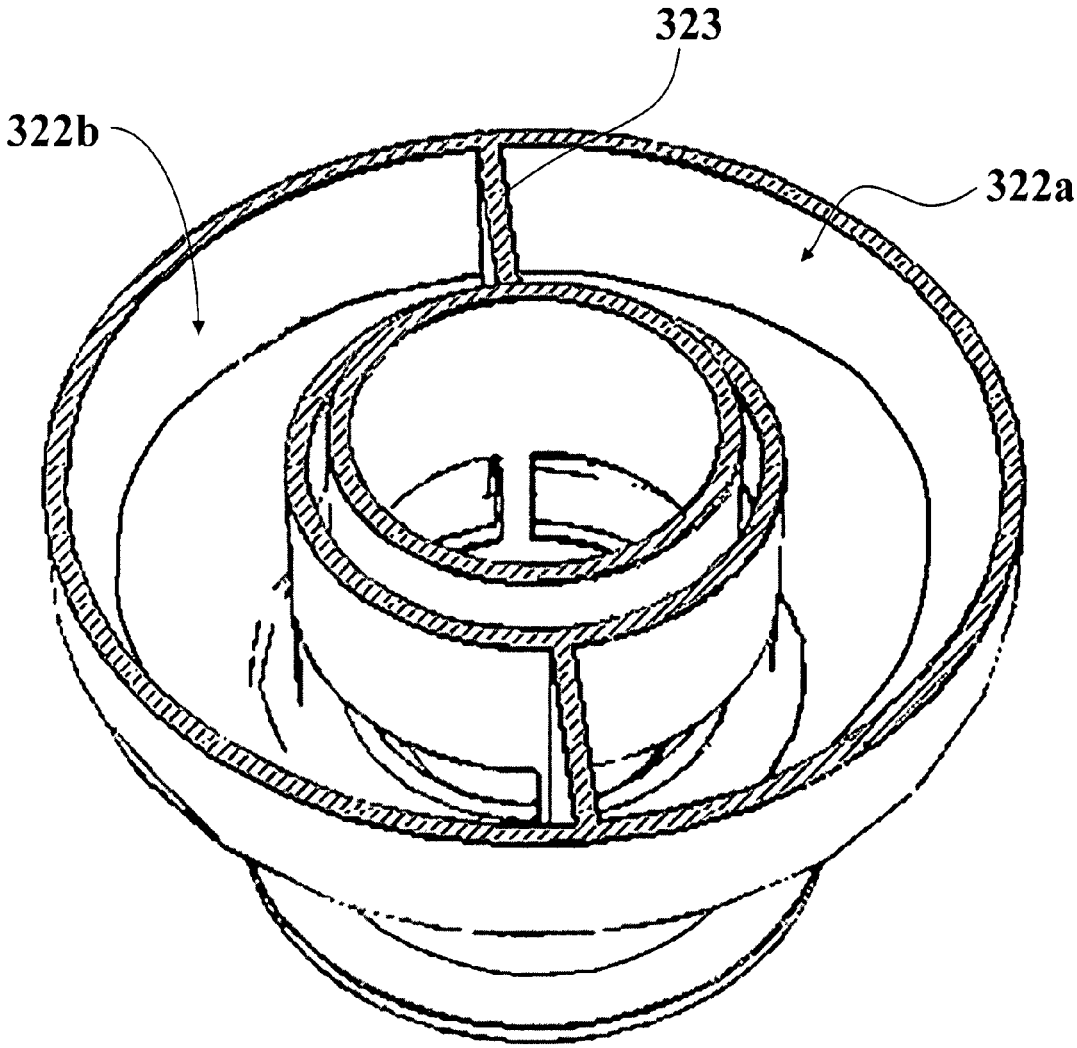
FIG. 16 is a cross-sectional perspective view of the mixing cap of FIG. 15.

To further control relative motion between outer housing 220 and inner tube 240, projection 255 is preferably included on exterior surface 244*a* of sidewall 244 of inner tube 240 at a location proximate, and preferably distal, medial flange 250. Projection 255 is preferably formed as ridge 255*a* having a length in an axial direction between medial flange 250 and base flange 252. Ridge 255*a* preferably includes wedge 259, such as non-reversible wedge 259*a*. In cooperation with ridge 255*a*, slot 229 is preferably formed in medial flange 228. If ridge 255*a* extends to medial flange 250, then slot 229 is preferably aligned therewith during assembly of mixing cap 200. The engagement of ridge 255*a* with slot 229 preferably prevents rotation between outer housing 220 and inner tube 240, so as to enable mixing cap 200 to be threaded onto bottle B via outer housing 220. Thus, if no rotation between outer housing 220 and inner tube 240, then ridge 255 may extend to medial flange 250 (as shown in FIG. 14*b*). Alternatively, ridge 255*a* may terminate at a point below medial flange 250, such that gap 257 is formed between ridge 255*a* and medial flange 250 at the location of medial flange 228 (as shown in FIG. 14*a*). Gap 257 is preferably approximately the same size as medial flange 228, such that medial flange 228 may fit in, and slide through, gap 257, whereby rotation between outer housing 220 and inner tube 240 is enabled. In this case, mixing cap 200 may preferably be threaded onto bottle B via inner tube 240. Gap 257 preferably allows slot 229 to be disposed in a position whereby ridge 255*a* is not disposed in alignment therewith. As such, ridge 255*a* preferably engages medial flange 228 such that outer housing 220 is prevented from sliding axially relative to inner tube 240, thereby preventing accidental or unwanted opening of mixing cap 200.

Non-reversible wedge 259*a* preferably comprises a resilient structure protruding from a surface of ridge 255*a*, such as surface 259*b*, formed as an angled surface or ramp, whereby axial sliding movement of medial flange 228 thereover causes surface 259*b* to compress, deflect, retract, or otherwise reduce a size of ridge 255*a* to a size less than or approximately equal to a size of slot 229 in a corresponding dimension. Surface 259*b* preferably increases a force necessary to slide outer housing over inner slot, thereby reducing or preventing accidental opening thereof. Thus, surface 259*b* preferably allows outer housing 220 to slide over inner tube 240 to open mixing cap 240 only upon application of a sufficient force. Surface 259*b* preferably returns to its original size (i.e. a size greater than the size of slot 229 in a corresponding dimension) when slot 229 passes thereover. The absence of an opposing surface preferably prevents outer housing 220 from returning to the closed position. Thus, non-reversible wedge 259*a* preferably prevents mixing cap 200 from being re-used.

Alternatively, second surface 259*d*, angled in opposite direction from surface 259*b*, may be provided to form reversible wedge 259*c* (See FIG. 14*b*). Second surface 259*d* preferably allows axial movement of outer housing 220 over inner tube 240 in a direction from an open position to a closed position, such as by causing deflection, compression, retraction, or the like to reduce the size of wedge 259 to a size less than the size of slot 229 in a corresponding dimension. Thus, reversible wedge 259*c* preferably allows mixing cap 200 to be reused, such as by refilling storage receptacle 223 with a selected ingredient while in the open position (i.e. such as after use) and then placing mixing cap 200 in the closed position.

As will be understood by those ordinarily skilled in the art, the flange arrangement described above may be modified without departing from the scope of the present invention. For example, in a simplified form, no flanges may be provided, whereby outer surface 244*a* of sidewall 244 may engage lower portion 224 so as to selectively prevent exposure of storage receptacle, and thus any contents stored therein, to one or more aperture 246. Alternatively, medial flange 250 may be omitted, such as to simplify construction and/or assembly of mixing cap 200.

Now referring to FIGS. 15-20, mixing cap 300 preferably facilitates separate storage of ingredients within separate compartments 322*a*, 322*b* of storage receptacle 322 of outer housing 320 via barrier 323 therebetween. Inner tube 340 preferably slidably engages central aperture 320*a* of outer housing 320, and preferably selectively prevents or allows dispensing of ingredients stored within storage receptacle 322 of outer housing 320.

Such engagement is preferably accomplished by abutting engagement of one or more portion of inner surface 325*a* of sidewall 325 of outer housing 320 with one or more portion of outer surface 341*b* of sidewall 341 of inner tube 340. Specifically, ring seal 331 is preferably disposed on inner surface 325*a* of sidewall 325, and preferably encircles one or more aperture 329 formed therethrough. Ring seal 331 preferably flushly abuts outer surface 341*b* proximate solid upper section 350 of sidewall 341. Thus, engagement of ring seal 331 with solid upper section 350 preferably prevents an ingredient contained within storage receptacle 322 from reaching central aperture 320*a*.

Additionally, upper flange 348 preferably extends from top 342 of inner tube 340 and engages at least one of ring seal 331 and sidewall 325. Upper flange 348, in combination with top wall 342, preferably further seals central aperture 320*a* from an exterior of mixing cap 300. An abutting interaction between ring seal 331 and upper flange 348 preferably limits axial motion between outer housing 320 and inner tube 340 so that inner tube 340 may preferably not be removed from central aperture 320*a*. Medial flange 354, likewise, preferably extends from outer surface 341*b* proximate lower portion 353 of sidewall 341 and preferably engages at least one of base flange 333 and sidewall 325 to further seal central cavity 320*a* and to further prevent inner tube 340 from being removed therefrom.

Figure 17:
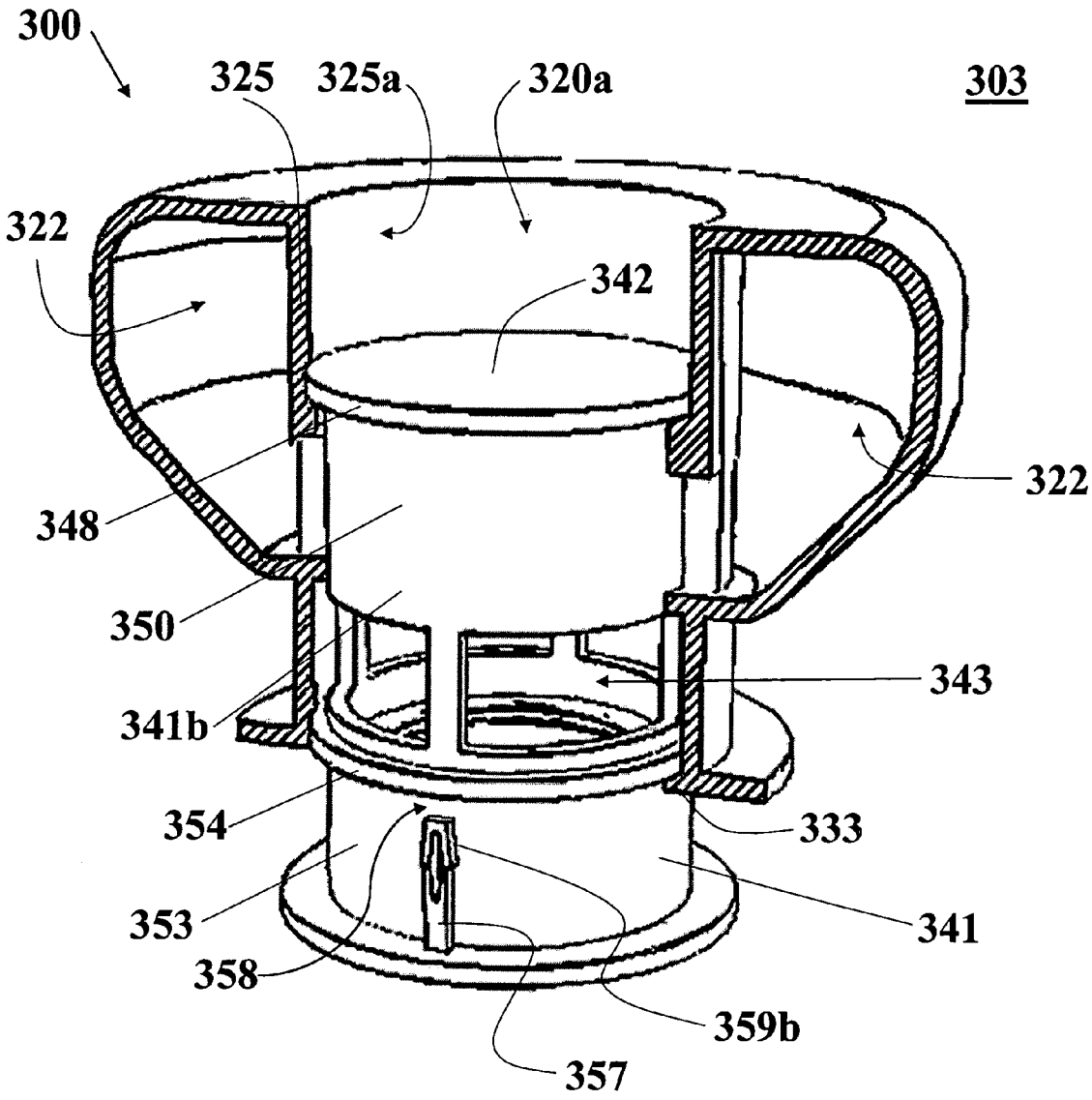
FIG. 17 is a partial cross-sectional perspective view of the mixing cap of FIG. 15.
Figure 18:
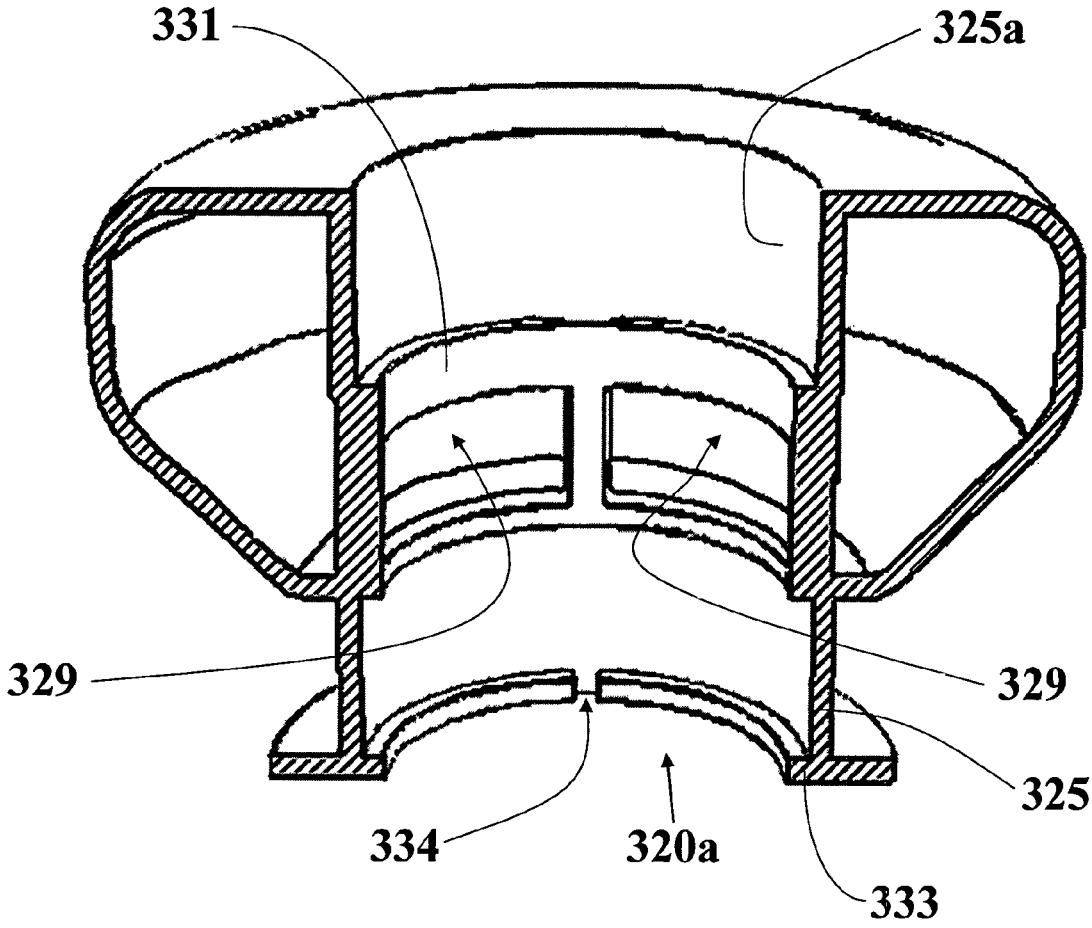
FIG. 18 is a cross-sectional perspective view of an outer housing of the mixing cap of FIG. 15.
Figure 19:
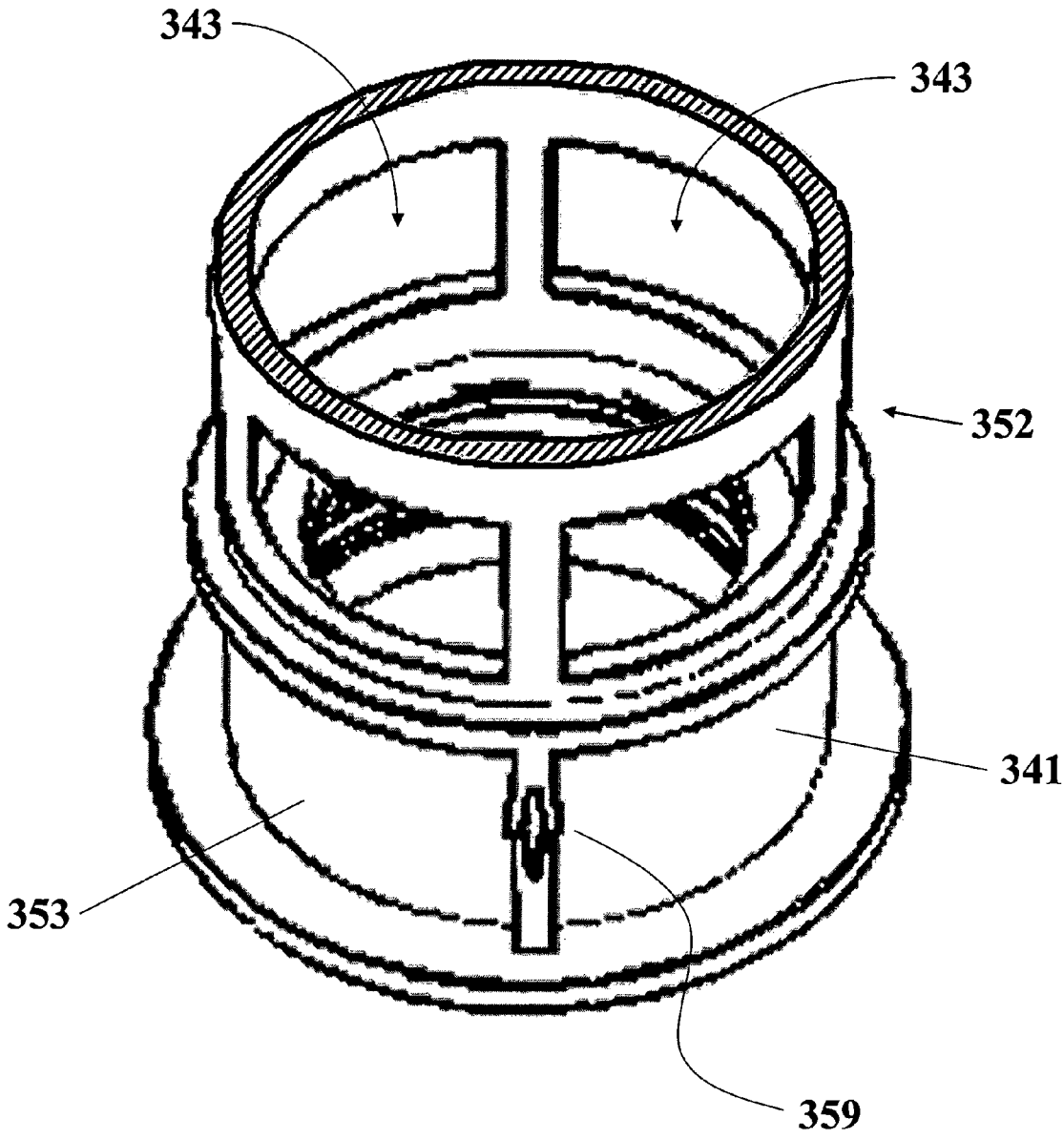
FIG. 19 is a cross-sectional perspective view of an inner tube of the mixing cap of FIG. 15.
Figure 20:
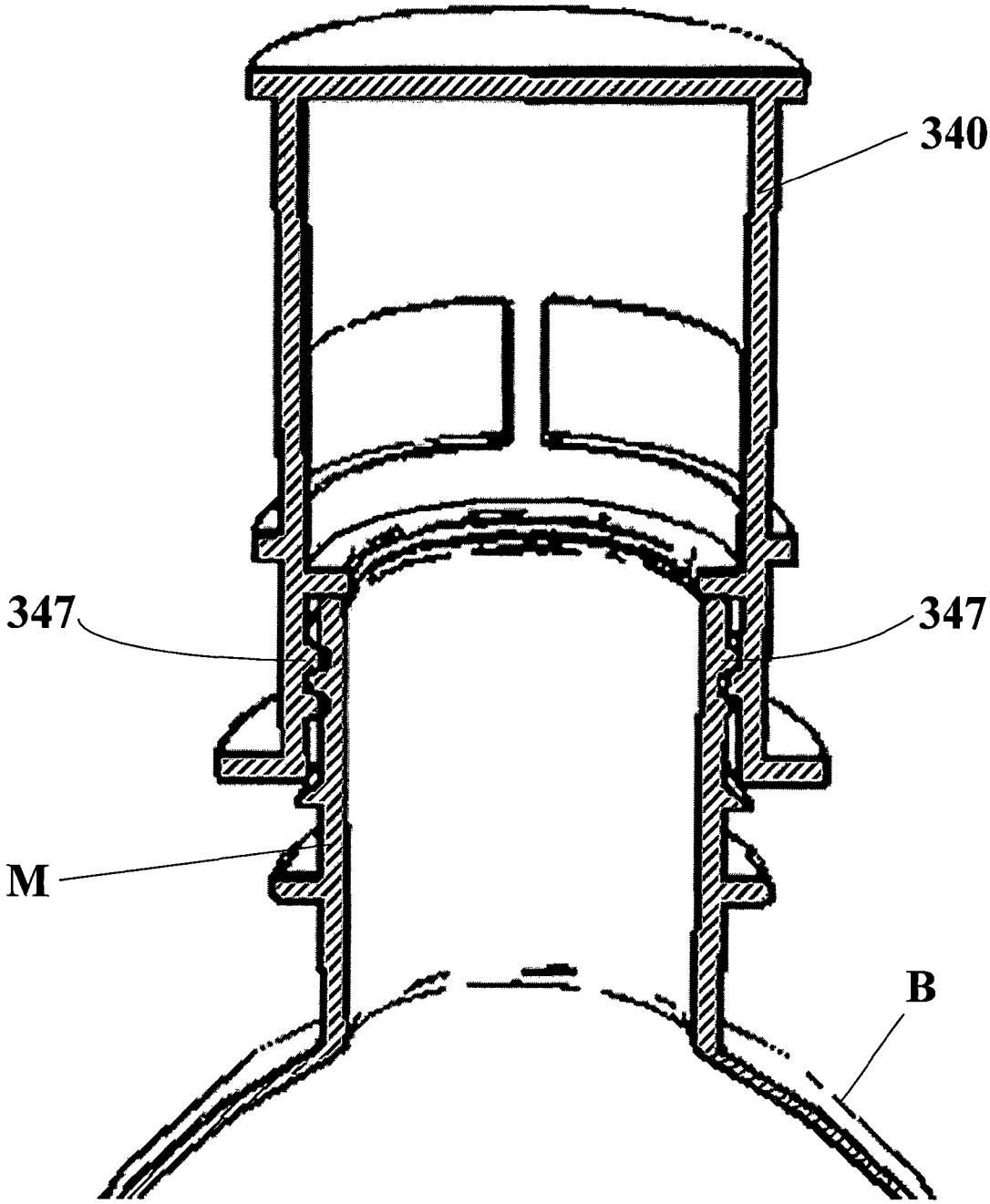
FIG. 20 is a cross-sectional perspective view of the inner tube of the mixing cap of FIG. 15 shown attached to a bottle.
Figure 21:
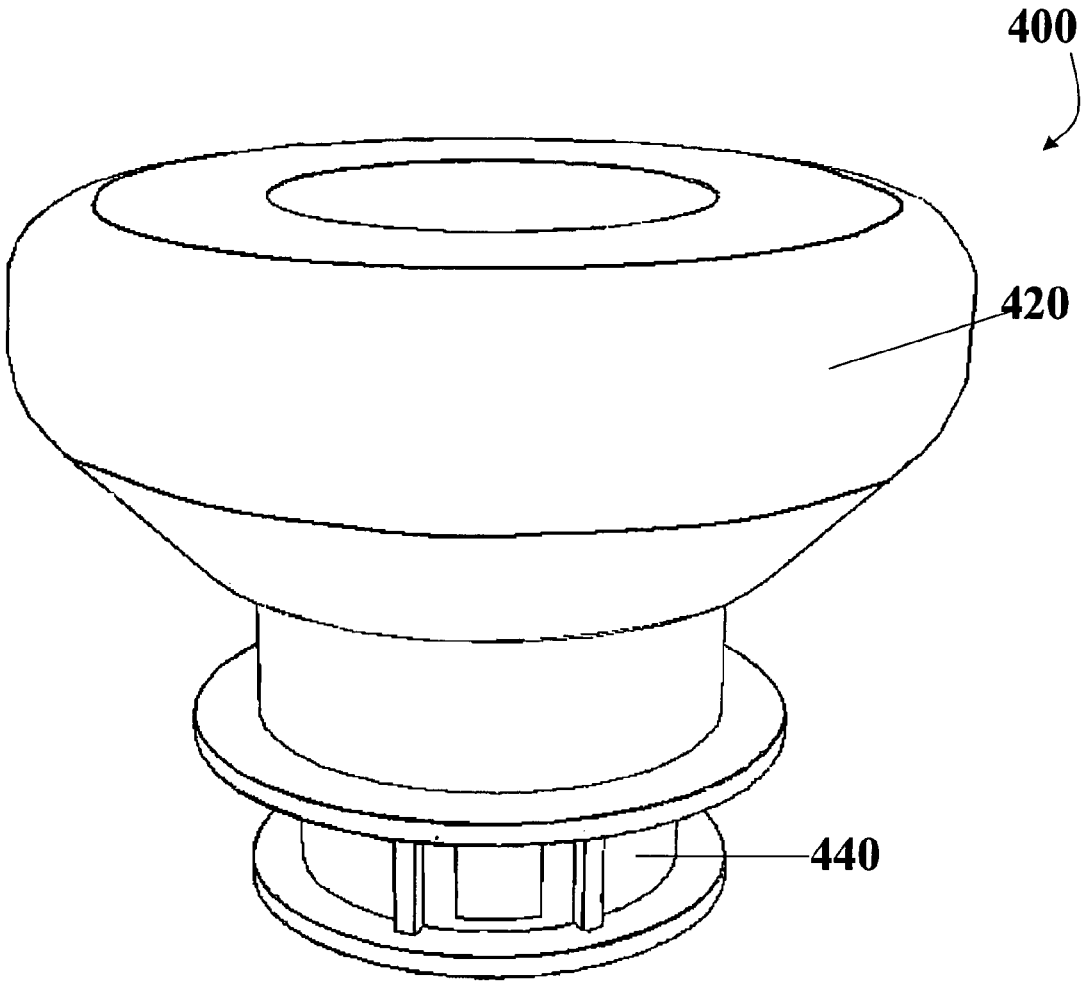
FIG. 21 is a perspective view of a two stage mixing cap according to the present invention.
Figure 22:
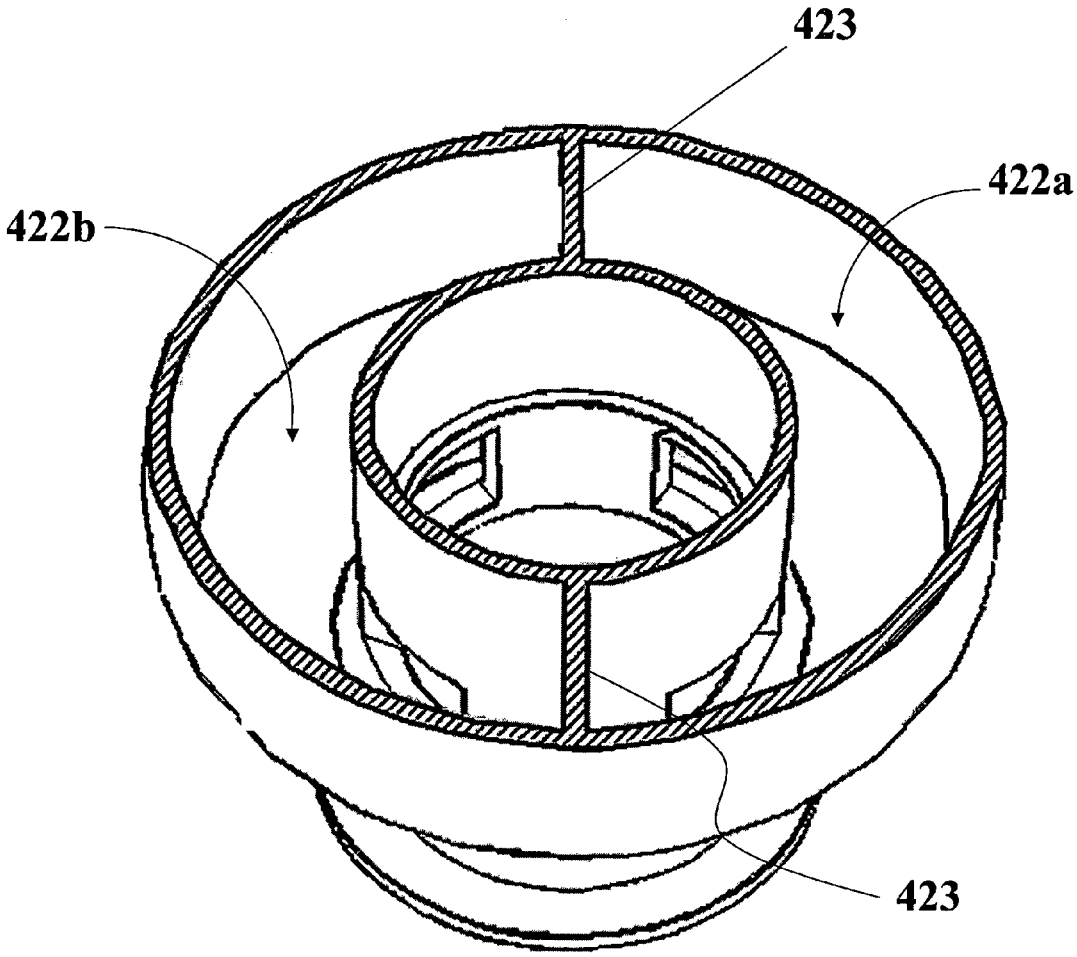
FIG. 22 is a cross-sectional perspective view of the mixing cap of FIG. 21.
Figure 23:
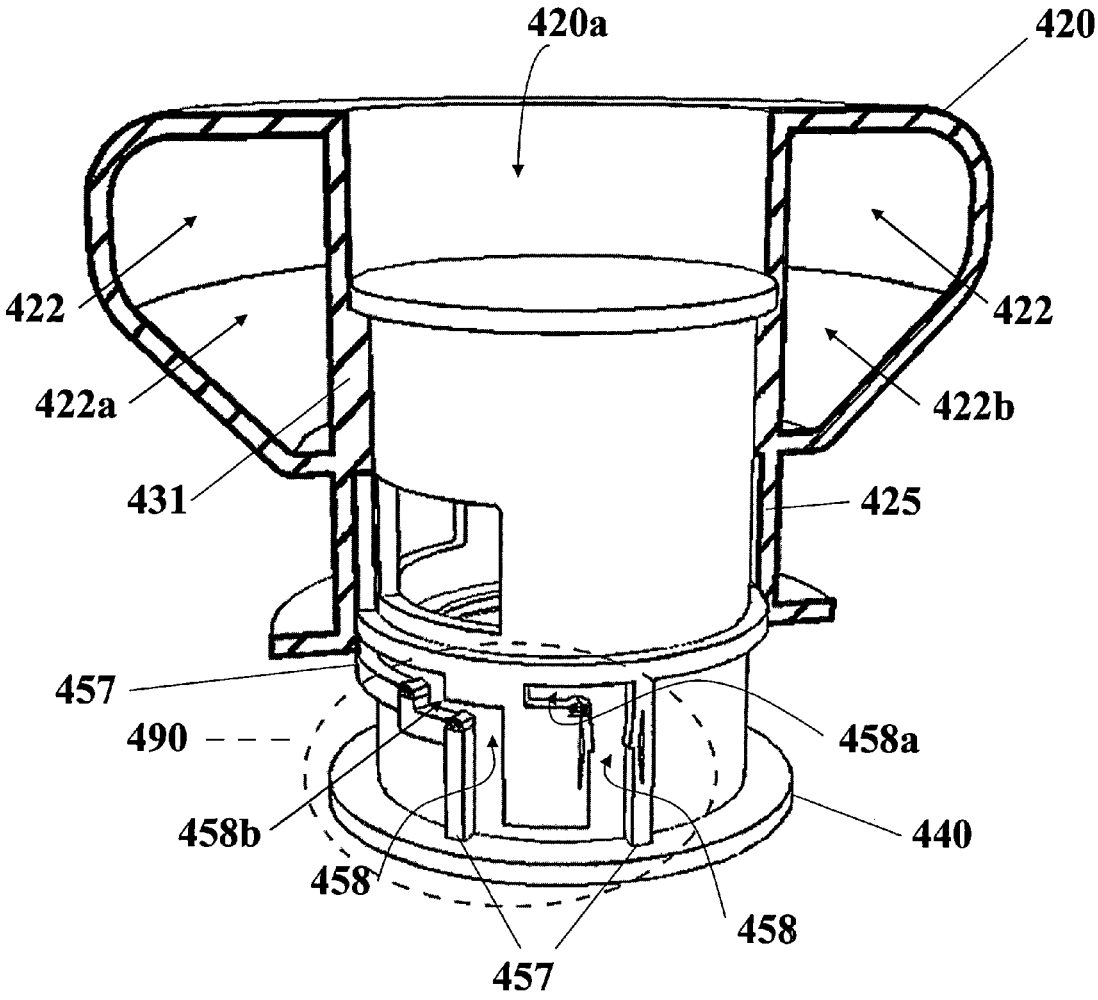
FIG. 23 is a partial cross-sectional view of the mixing cap of FIG. 21.
Figure 24:
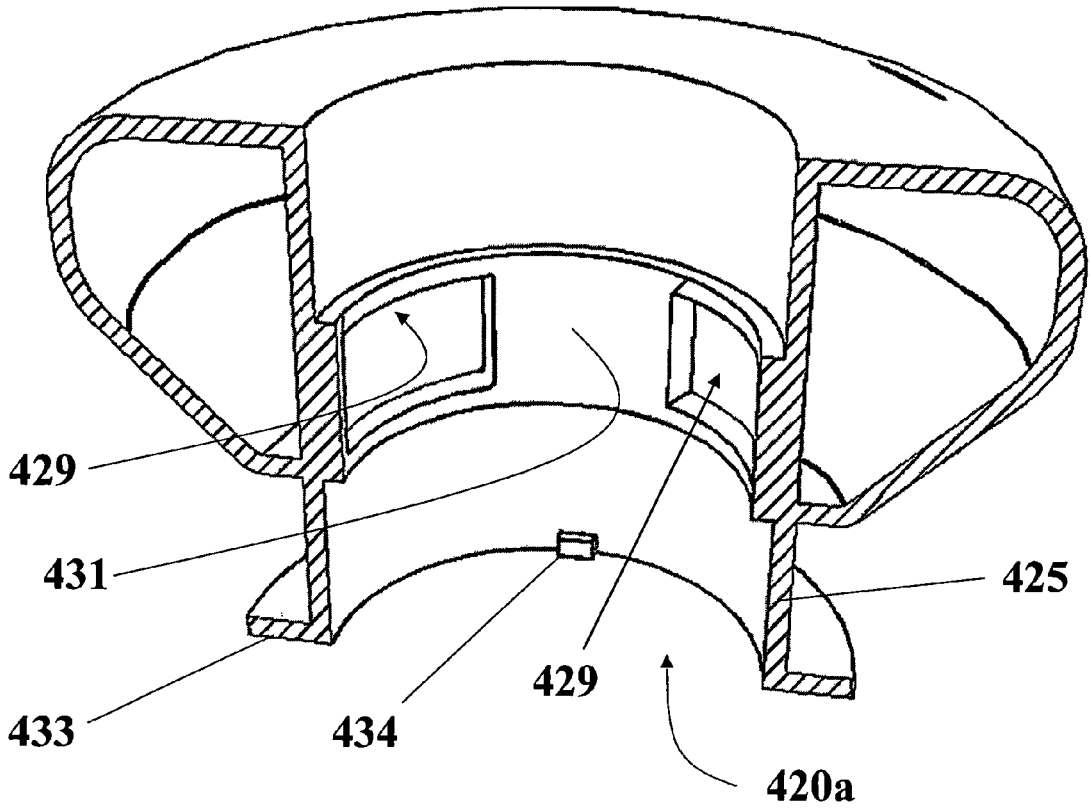
FIG. 24 is a cross-sectional perspective view of an outer housing of the mixing cap of FIG. 21.
Figure 25:
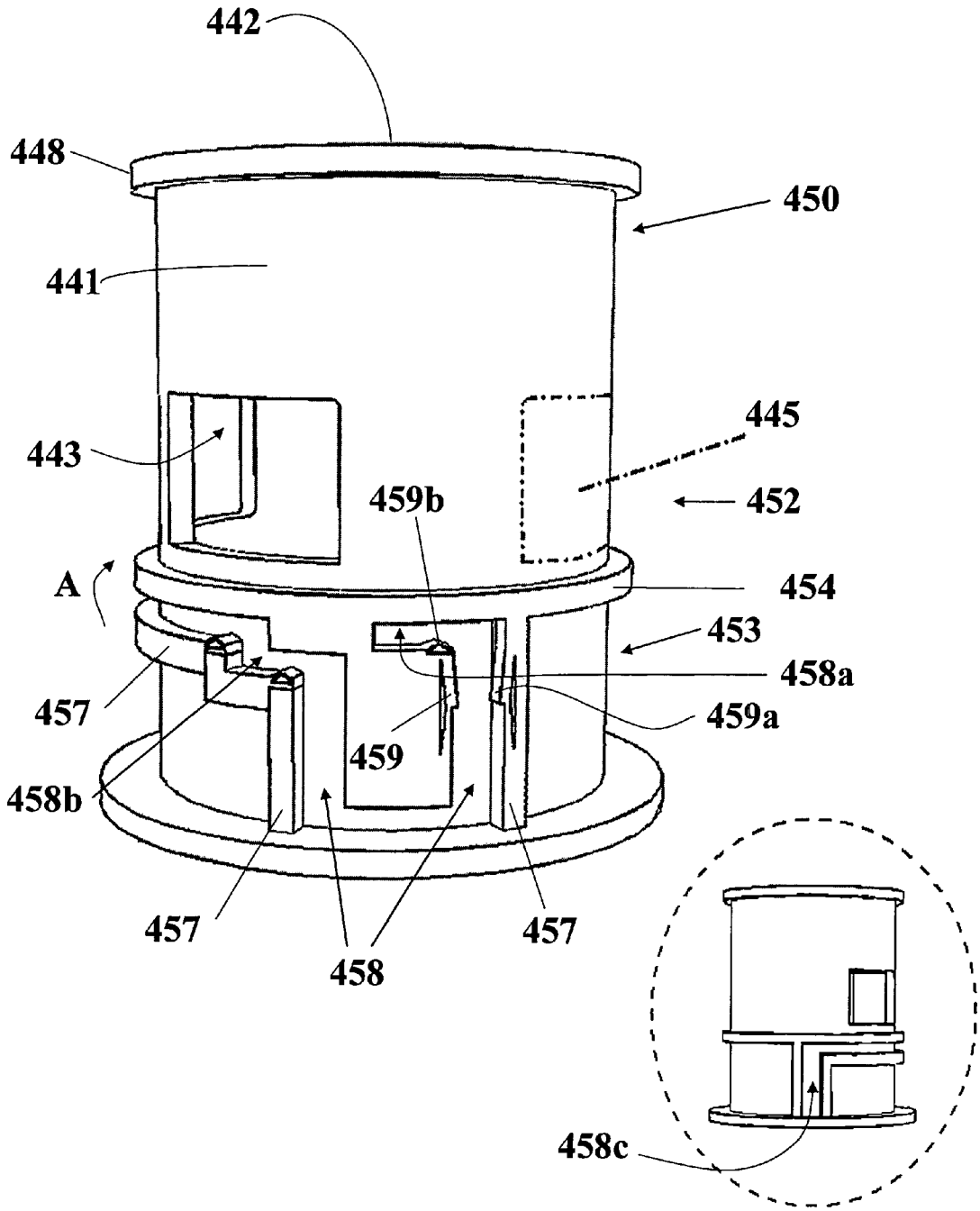
FIG. 25 is a perspective view of an inner tube of the mixing cap of FIG. 21.
Figure 26A:
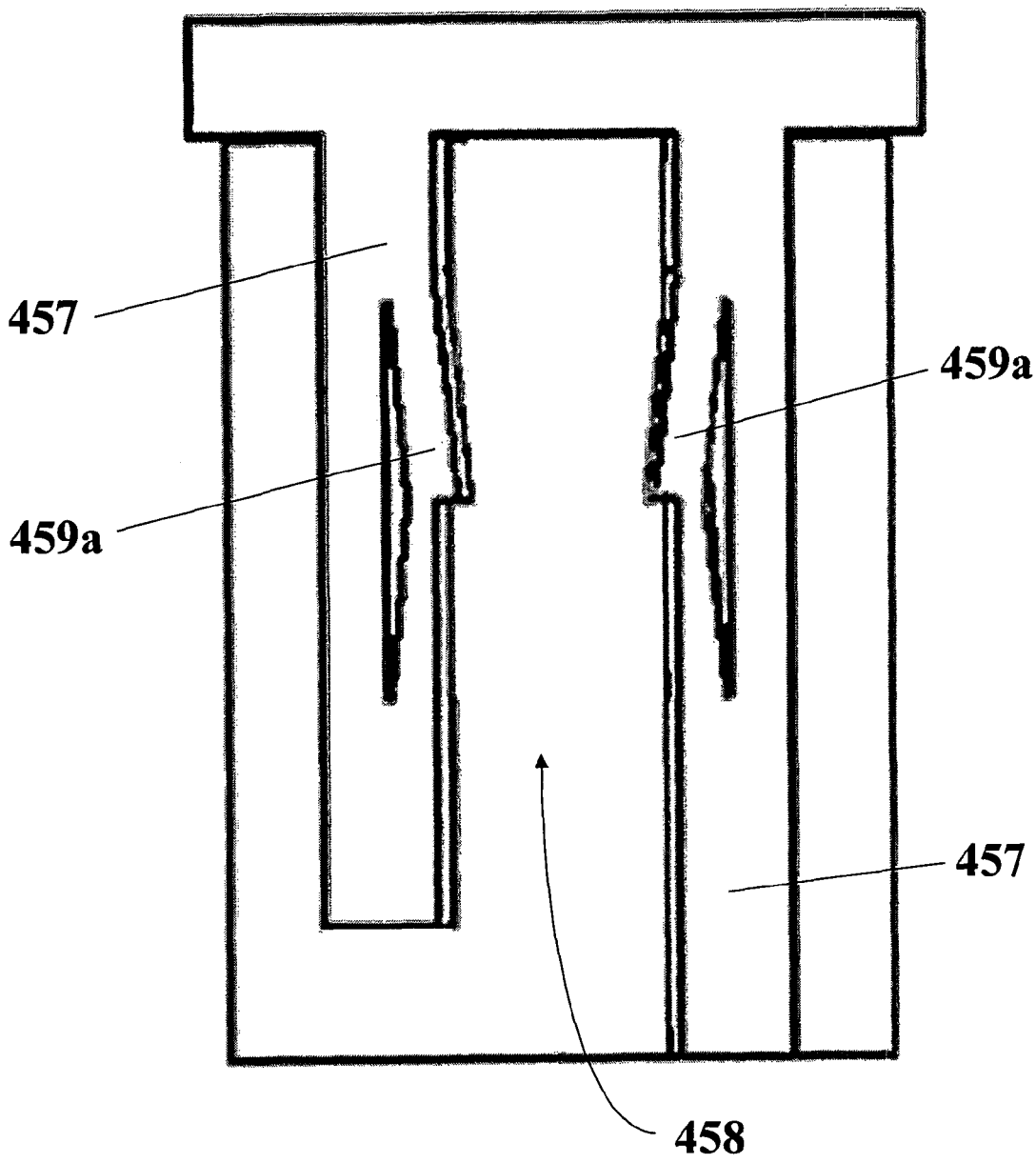
FIG. 26*a* is a front view of a control means of the mixing cap of the present invention.
Figure 26B:
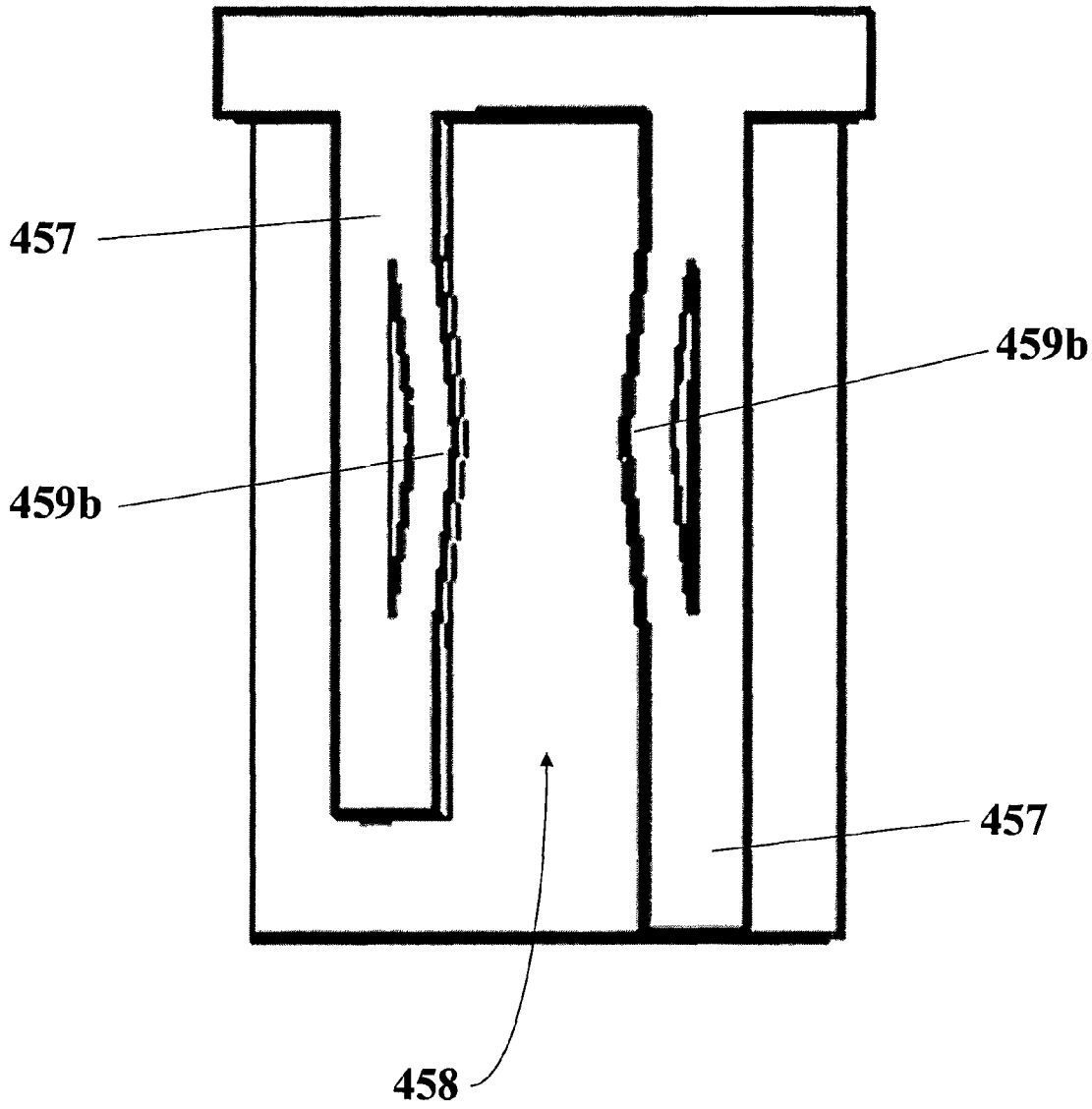
FIG. 26*b* is a front view of an alternate control means of the mixing cap of the present invention.

One or more aperture 343 is preferably formed through sidewall 341 proximate medial portion 352 thereof, and is preferably located such that they are not in communication with one or more aperture 329, and thus not in communication with storage receptacle 322 when mixing cap 300 is in closed position 303 (shown in FIG. 17). Mixing cap 300 is preferably opened by depressing outer housing 320 over inner tube 340, thereby cause relative axial motion therebetween, whereby apertures 329 through ring seal 331 preferably slide towards lower portion 353 such that apertures 329 preferably align, at least partially, with apertures 343. Upon such opening, an ingredient material, such as a powder or a liquid ingredient, may preferably flow out from separate compartments 322*a*, 322*b* of storage receptacle 322 through apertures 329, 343 and into inner tube 340. Thus, opening mixing cap 300 preferably allows ingredients stored separately therein to be approximately simultaneously discharged into bottle B, connected to mixing cap 300 via connection means 347, such as threads or the like, for connecting inner tube 340 to mouth M of bottle B.

In order to prevent inadvertent or otherwise unwanted opening of mixing cap 300, ridge 357 is preferably provided on lower portion 353 such that depression of outer housing 320 over inner tube 340 is selectively prevented via interaction of base flange 333 with slot 334 with gap 358 and ridge 357 and/or via control means 359, such as wedge 359*b* formed on ridge 357.

Now referring to FIGS. 21-26*b*, mixing cap 400 preferably facilitates selective dispensing of separate ingredients stored therein via guide means 490. Mixing cap 400 preferably functions, at least in most respects, like mixing caps 100, 300 with respect to separation of ingredients. Thus, outer housing 420 preferably includes storage receptacle 422, including separate compartments thereof 422*a* and 422*b* separated by partition 423.

Outer housing 420 preferably further includes apertures 429 disposed through ring seal 431 of sidewall 425. Outer housing 420 preferably further includes tab 434 projecting into central aperture 420*a* from sidewall 425 proximate base 433.

Inner housing preferably includes top 442 and sidewall 441 depending therefrom, generally at a peripheral portion. Top 442 preferably includes upper flange 448 for engagement with sidewall 425 and/or ring seal 431. Sidewall 441 preferably includes upper portion 450, lower portion 453, and medial portion 452 therebetween. Sidewall 441 is preferably solid in upper portion 450, such that upper portion 450 seals apertures 429 of outer housing 420 via abutting engagement with ring seal 431. Sidewall 441 preferably includes a plurality of ridges 457, defining channel 458 therebetween, proximate lower portion 453 and below medial flange 454. Ridges 457 may optionally include wedge means 459 thereon for controlling movement of tab 434 therein, as described in more detail below. Sidewall 441 preferably further includes apertures 443 therethrough and solid portion 445 over medial portion 452.

Inner tube 440 is preferably initially arranged within outer housing 420 such that tab 434 is preferably disposed within channel 458 proximate first end 458*a*, and such that mixing cap 400 is preferably closed with at least one ingredient disposed within storage receptacle 422. In use, outer housing 420 is preferably depressed over inner tube 440, thereby opening mixing cap 400 and allowing at least one ingredient stored within separate compartment 422*a* to flow out through apertures 429 and 443. Such depression preferably does not allow one or more ingredients stored within separate compartment 422*b* to flow out, such as via solid portion 445. Once the one or more ingredient(s) in separate compartment 422*a* is(are) used, one or more ingredient(s) contained in separate compartment 422*b* may be used by aligning apertures 429 associated therewith and apertures 443 of inner tube 440. In order accomplish such alignment, outer housing 420 may preferably be moved over inner tube 440, such that separate compartment 422*b* is disposed proximate apertures 443.

Motion between inner tube 440 and outer housing 420 is preferably controlled via control means 490. Thus, outer housing 420 preferably follows a predetermined path over inner tube 440, such as channel 458. Specifically, tab 434 is preferably constrained within channel 458 via ridges 457. According to a preferred embodiment, first end 458*a* of channel 458 preferably prevents outer housing 420 from being depressed or rotated via tab 434 abutting a ridge disposed therebelow and therebeside. Thus, the only initial motion that is possible is a movement of outer housing 420 in an axial direction that does not open mixing cap 400. From there, outer housing 420 is preferably constrained to rotation in a single direction, towards an axial extent of channel 458 that will enable activation of separate compartment 422*a*. Thus, accidental activation or opening of one or more of separate compartments 422*a* and 422*b* (or more if additional dividers and apertures are provided) may be prevented via an arrangement of channel 458, or other arrangement of guide means 490. Ridges 457 preferably further include non-reversible wedges 459*a* and/or reversible wedges 459*b* over selected portions thereof, such as axial portions, so as to prevent or allow re-use of mixing cap 400.

Preferably, tab 434 first rotates over reversible wedge 459*b*, then axially down over non-reversible wedges 459*a* along channel 458 from first end 458*a* thereof, whereby first compartment 422*a* is opened, and may dispense contents through apertures 429 and 443. Tab 434 may then be rotated and moved axially along channel 458 to medial point 458*b* where neither first compartment 422*a* nor second compartment 422*b* is open. When desired, second compartment 422*b* may be opened by moving tab 434 further along channel 458 in the direction of arrow A to second end 458*c* of channel 458, whereby one or more opening 429 associated with second compartment 422*b* may be disposed proximate opening 443. Outer housing 420 may then be depressed over inner tube 440, whereby second compartment 422*b* is opened, thereby allowing contents thereof to be dispensed.

Figure 27:
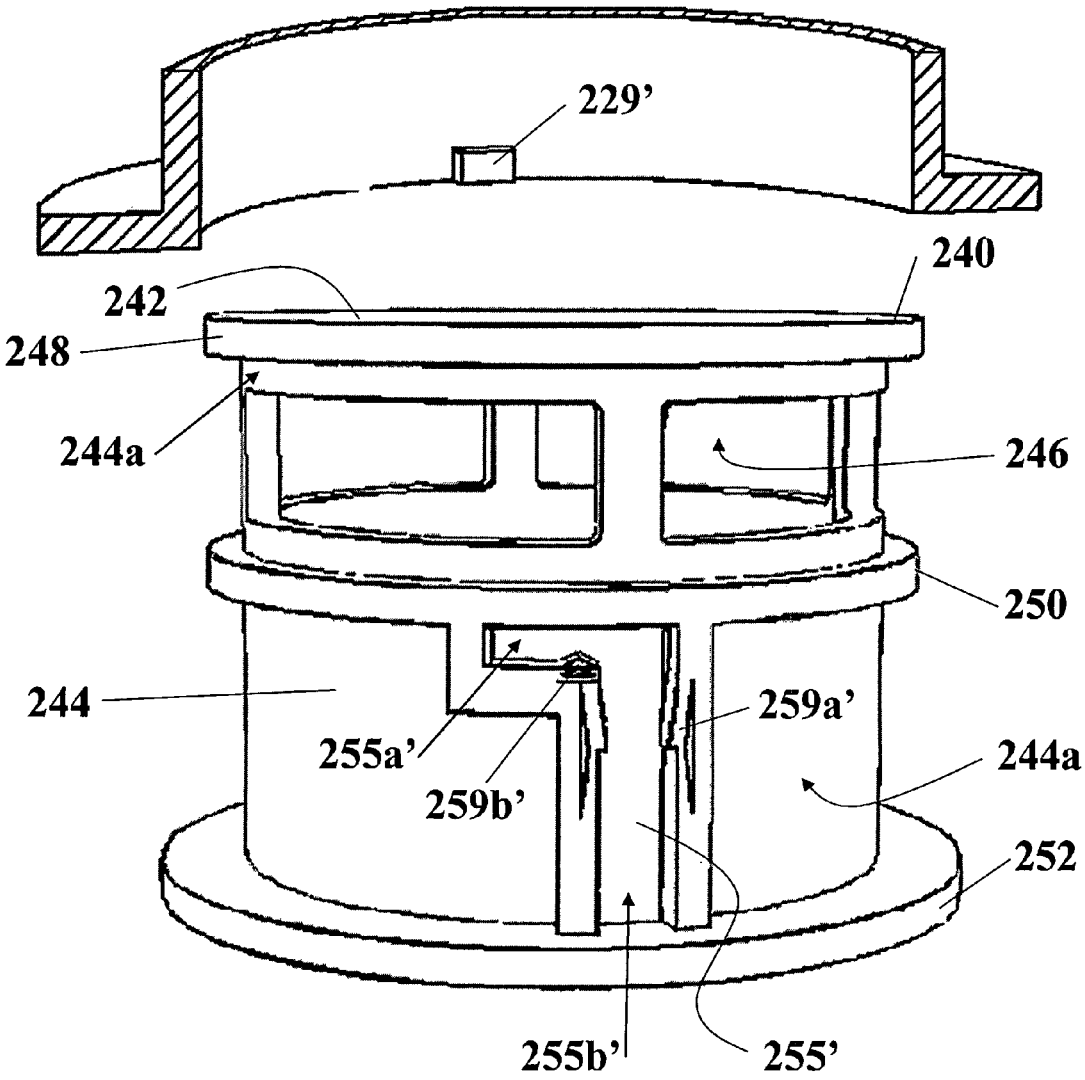
FIG. 27 is a front view of an alternate control means of the mixing cap of the present invention.

Referring now to FIG. 27, any pair of slot and ridge, such as slot 229 and ridge 255, may be replaced by a channel and a tab, such as channel 255' and tab 229', whereby selective opening of a mixing cap may be enabled. For example, for a single-compartment mixing cap, such as mixing cap 200, selective opening thereof may be enabled via engagement of tab 229' with 255', whereby axial movement of outer housing 220 over inner tube 240 is prevented when tab 229' is disposed proximate first end 255*a'* of channel 255'. In order to open the mixing cap, outer housing 220 must be rotated about inner tube 240 until tab 229' passes over wedge 259*b'*, whereafter outer housing 220 may slide axially over inner tube 240, over wedge 259*a'*, to second end 255*b'* of channel 255'.

Figure 28:
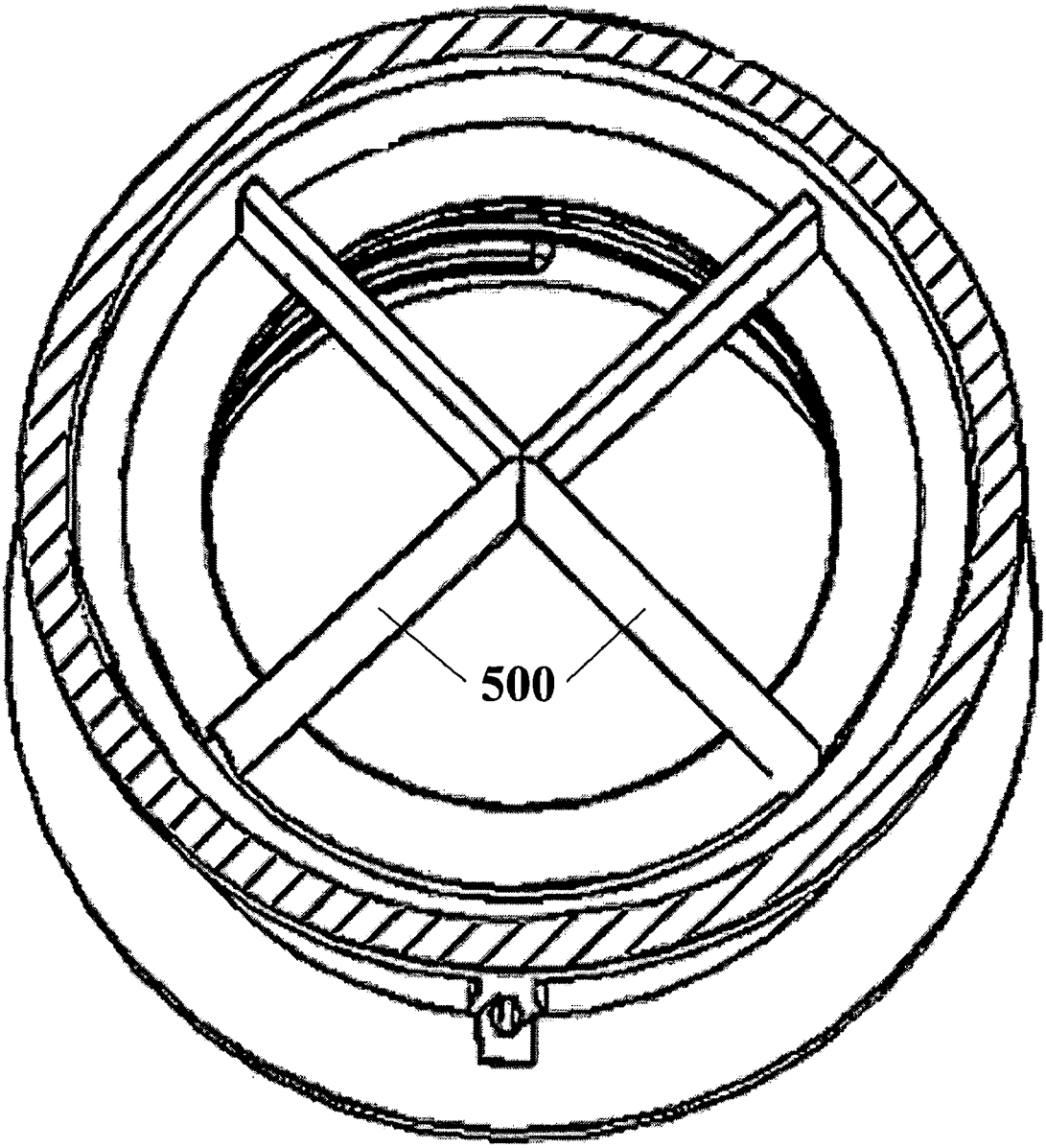
FIG. 28 is a top cross-sectional view of an inner tube having optional cross-members.

Referring now to FIG. 28, one or more member 500 may be disposed within an inner tube or a mixing cap according to the present invention, whereby mixing of one or more ingredient(s) disposed in the mixing cap with the contents of bottle B may be facilitated. Specifically, each member 500 may be formed within a path from one or more compartment of the mixing cap to bottle B, whereby clumps or other clusters of the ingredient bay be broken up via mechanical agitation, and mixing flows or turbulence within a liquid ingredient or content of bottle B may be introduced. In one embodiment, each member 500 may be adapted to facilitate swirling of liquid passing thereover, whether it be liquid entering the mixing cap from bottle B, or whether it be liquid entering bottle B from the mixing cap, whereby the swirling may facilitate complete, or at least adequate mixing of the liquid.

Figure 29:
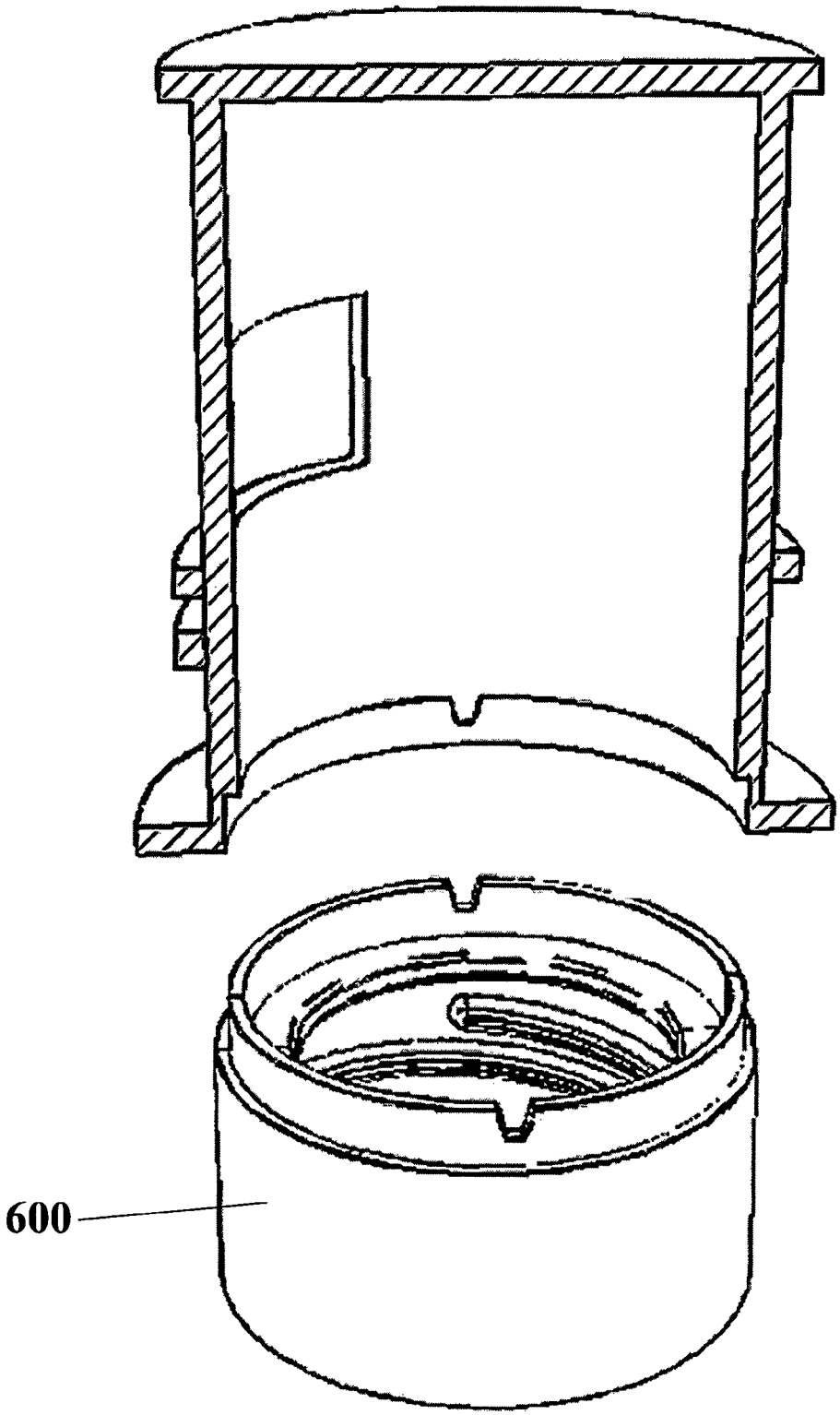
FIG. 29 is a front partial-cross-sectional view of a threaded member adapted for attachment to an inner tube of the present invention.
Figure 30:
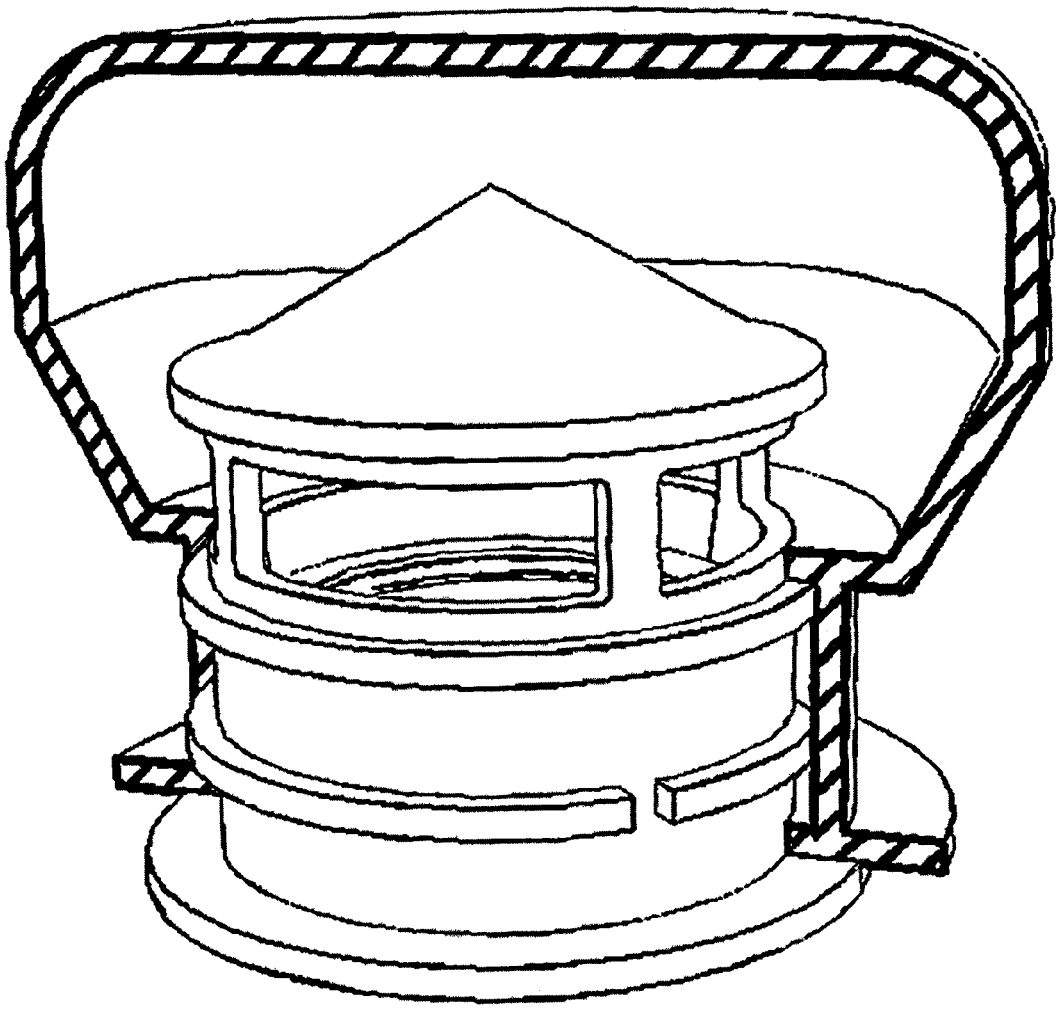
FIG. 30 is a front partial-cross-sectional perspective view of a mixing cap according to an alternate embodiment.
Figure 31:
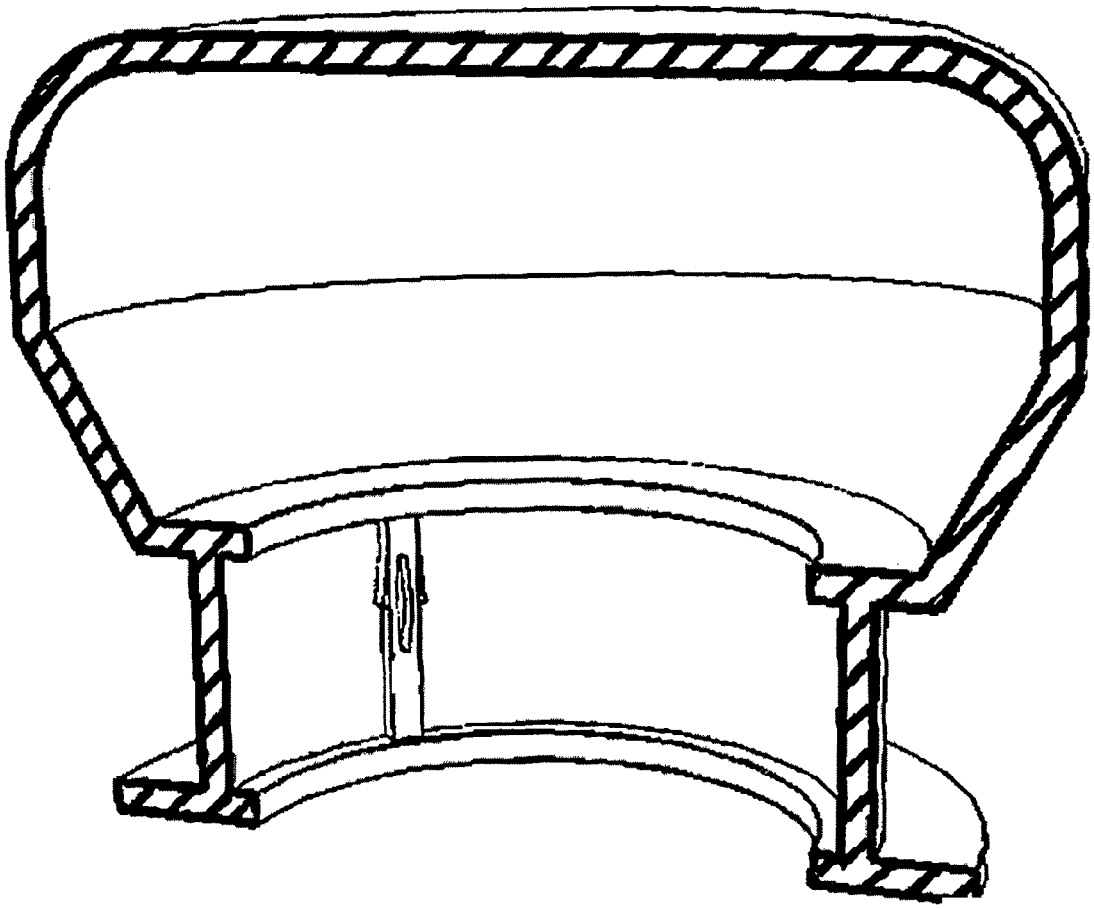
FIG. 31 is a cross-sectional view of an outer housing according to the embodiment of FIG. 30.
Figure 32:
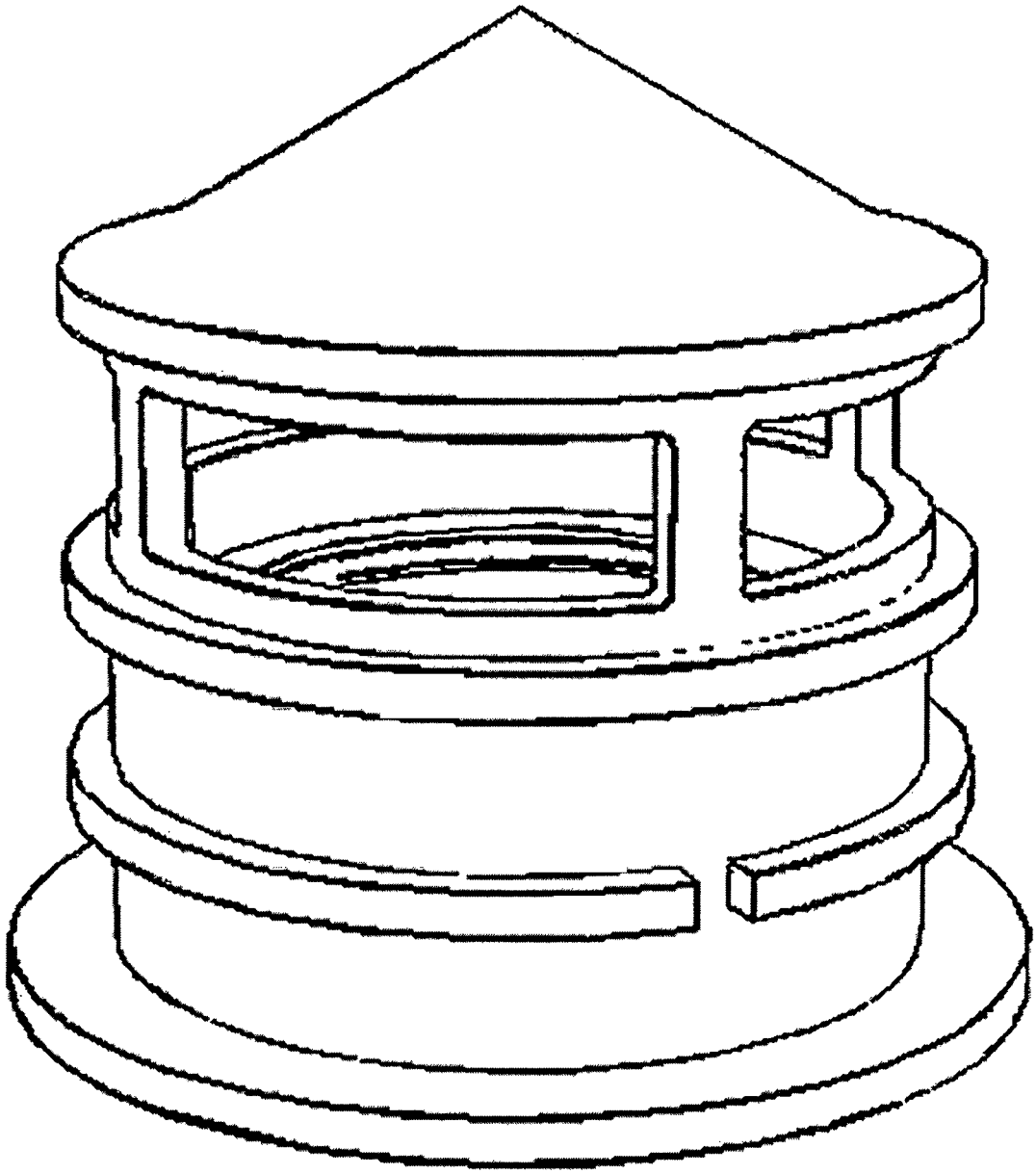
FIG. 32 is a front perspective view of an inner tube according to the embodiment of FIG. 30.
Figure 33:
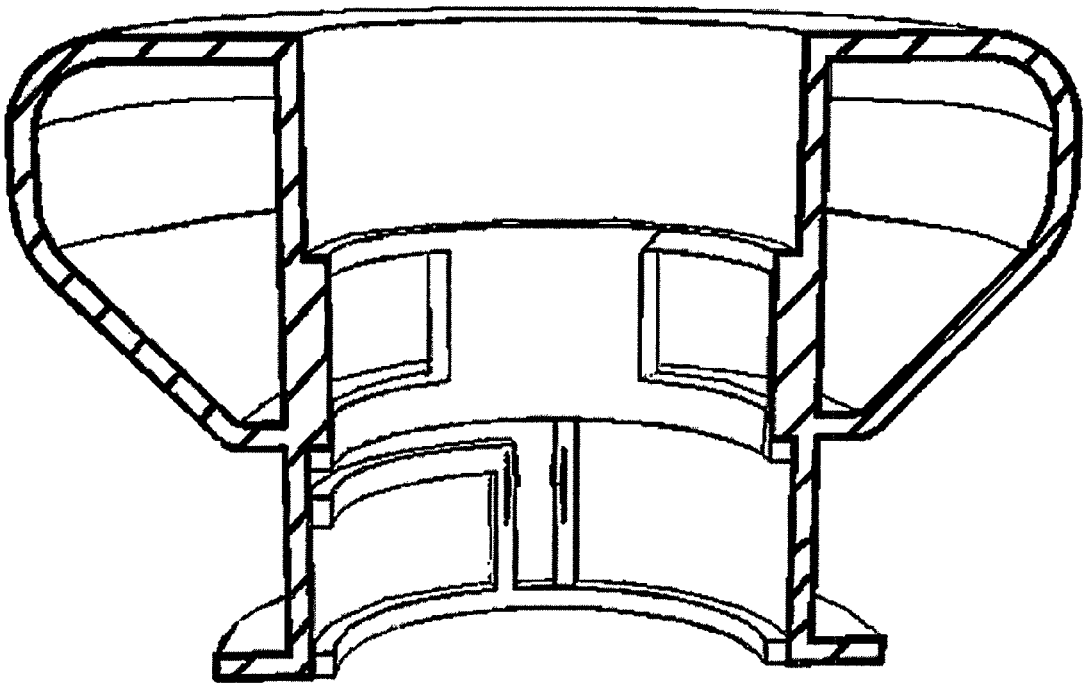
FIG. 33 is a cross-sectional view of an outer housing according to yet an alternative dual-stage, multi-compartment mixing cap according to an alternate embodiment of the present invention.
Figure 34:
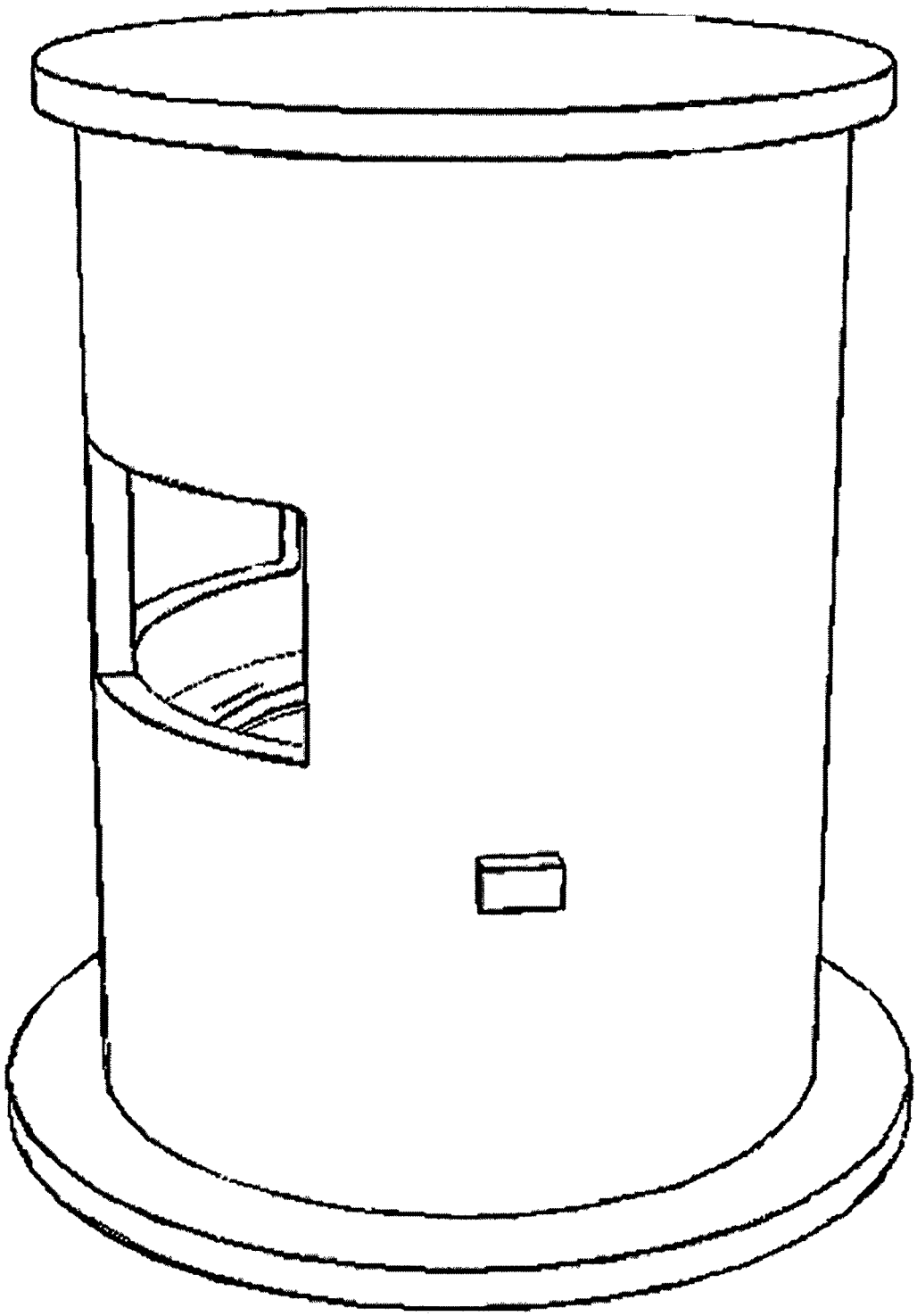
FIG. 34 is a front view of an inner tube adapted for engagement with the outer housing of FIG. 33.

As shown in FIG. 29, portion 600 may be separately formed and engageable with an inner tube of a mixing cap of the present invention, whereby a given inner tube configuration may be adapted to engage threads of a selected one of a plurality of varying bottle designs, such as those having different mouth diameters, thread angles, or the like. Thus, a number of molds, forming techniques, or parts necessary to manufacture different mixing caps adapted to engage respective different bottles may be reduced to reduce a cost, time, complication, or the like, of manufacturing.

It will be understood by one of ordinary skill in the art, that while the mixing caps of the present invention have been illustrated according to the forms presented and described herein, alternate forms are contemplated, including alternate shapes and/or designs. For example, the outer housing may be generally spherical, torroidal, cylindrical, polygonal, arcuate, curvilinear, angular, or the like.

Furthermore, while the operation of the mixing caps of the present invention have been described and illustrated including specific control means and/or guide means, such as the ridges, slots, gaps, tabs, channels, wedges, and the like described hereinabove, it will be understood that alternative control means and/or guide means may be included, such as operable means such as a button or other device for triggering actuation or opening of one or more storage compartment, and the guide means and control means specifically described may be rearranged to achieve the purpose of controlling, limiting, and/or allowing relative motion between an outer housing and an inner tube engaged therewith, particularly for aligning apertures therein to allow ingredient to flow from a storage compartment into a bottle or other container. Additionally, and as shown in FIGS. 30-34, the ridges, slots, tabs, channels, or the like described above with respect to mixing caps 100, 200, 300, and 400, may be reversed, i.e. wherein structures formed on an inner tube may be formed on a respective outer housing, and vice-versa.

Having thus described exemplary embodiments of the present invention, it should be noted by those ordinarily skilled in the art that the within disclosures are exemplary only, and that various other alternatives, adaptations, and modifications may be made within the scope of the present invention. For example, one or more compartment(s) may be formed within or associated with the inner tube, and the outer housing may act as a conduit for one or more ingredient(s) from respective a respective compartment to a bottle. Similarly, other arrangements than the cylindrical inner tube, and the outer housing, may be employed whereby guide means selectively control the opening of one or more separate compartment(s), either simultaneously or sequentially. Accordingly, the present invention is not limited to the specific embodiments illustrated herein, but is limited only by the following claims.

What is claimed is:

1. A mixing cap comprising:

an outer housing comprising a storage compartment for storing an ingredient to be mixed;

an inner tube cooperatively engaged with said outer housing, said inner tube comprising a central bore through which the ingredient may be dispensed;

means for controlling relative movement between said outer housing and said inner tube, said means comprising a ridge formed on a first surface of said mixing cap and a slot formed in a second surface of said mixing cap, said ridge engageable with said slot to allow motion of said ridge within said slot;

said ridge comprising means for increasing a force necessary to slide said slot over said ridge in at least one direction.

2. The mixing cap of claim 1, wherein axial movement of said outer housing relative to said inner tube allows a position to be selected, wherein the ingredient can flow though through said central bore.

3. The mixing cap of claim 1, wherein said ridge comprises means for preventing passage of said slot over said ridge in at least one direction.

4. The mixing cap of claim 1, wherein said outer housing comprises at least one aperture providing access to said storage compartment, and wherein said inner tube comprises at least one aperture providing access to said central bore.

5. A mixing cap comprising:

an outer housing comprising a first storage receptacle for storing a first ingredient and a second storage receptacle for storing a second ingredient, said second storage receptacle being separate from said first storage receptacle;

means for selectively dispensing at least one of said first ingredient and said second ingredient through a common neck defined by an inner tube cooperatively engaged with said outer housing;

means for controlling relative movement between said outer housing and said inner tube, said means comprising a ridge formed on a first surface of said mixing cap and a slot formed in a second surface of said mixing cap, said ridge engageable with said slot to allow motion of said ridge within said slot;

said ridge comprising means for increasing a force necessary to slide said slot over said ridge in at least one direction.

6. The mixing cap of claim 5, wherein said first ingredient is dispensed from said first storage receptacle at a first time, and said second ingredient is dispensed from said second storage receptacle at a second time.

7. The mixing cap of claim 5, wherein said means for selectively dispensing prevents simultaneous dispensing of ingredients from said first storage receptacle and said second storage receptacle.

8. A mixing cap for removable engagement with a container, said mixing cap comprising:

a housing defining a compartment and at least one aperture allowing access to said compartment;

a conduit cooperatively engaged with said aperture to selectively seal said aperture;

means for controlling relative movement between said housing and said conduit, said means comprising a ridge formed on a first surface of said mixing cap and a slot formed in a second surface of said mixing cap, said ridge engageable with said slot to allow motion of said ridge within said slot;

said ridge comprising means for increasing a force necessary to slide said slot over said ridge in at least one direction;

wherein unsealing said aperture allows a material contained within said housing to flow through said conduit.

* * * * *